US005815186A

United States Patent [19]

Lewis et al.

[11] Patent Number: 5,815,186

[45] Date of Patent: Sep. 29, 1998

[54] REMOVABLE ROLL-FEED APPARATUS AND METHOD

[75] Inventors: Richard Lewis; Antonio Hinojosa, both of Sant Cugat del Vallè, Spain; Richard Meyer, Alfred, Me.; Cheryl Kisicki, Grand Island, N.Y.; Jennifer P. Palmatier, Milton Mills, N.H.; Joaquim Brugue; Xavier Regué , both of Sant Cugat del Vallè, Spain

[73] Assignee: Hewlett-Packard Company, Palo Alto, Calif.

[21] Appl. No.: 658,346

[22] Filed: Apr. 29, 1996

[51] Int. Cl.[6] ..... B41J 2/01

[52] U.S. Cl. ..... 347/101; 347/104; 400/605; 400/607

[58] Field of Search ..... 347/101, 104, 347/1; 355/310; 400/584, 585, 585.1, 594, 594.1, 621, 605, 607, 611, 613, 692; 242/596.8, 598.5, 598.6; 346/136, 134, 139 R, 1.1

[56] References Cited

U.S. PATENT DOCUMENTS 5,296,872 3/1994 Caamano ..... 346/24

5,516,219 5/1996 Leonard et al. ..... 400/613

*Primary Examiner*—Benjamin R. Fuller

*Assistant Examiner*—Juanita Stephens

[57] ABSTRACT

A removable roll-feed apparatus that is removably attachable to a printer/plotter. Inexpensive printer/plotters will have the option of the attachment of a simple, but yet reliable, roll-feed apparatus which is easily attached to the printer/plotter without requiring any special training or dexterity on the part of an operator. Datum points and surfaces are provided to locate the printer/plotter in the X, Y and Z-directions, and when the roll-feed apparatus is attached to the printer/plotter, an operator will have the option of feeding the printer/plotter with roll media or single sheet media. Having the roll-feed apparatus attached to the printer/plotter does not restrict single sheet feeding. The roll-feed apparatus also provides a media self-alignment feature and a simple, but effective, hand-operated cutting apparatus to separate completed plots from the printer/plotter.

16 Claims, 40 Drawing Sheets

REMOVABLE ROLL-FEED APPARATUS AND METHOD

BACKGROUND OF THE INVENTION

1. Field of the Invention

The present invention relates to a removable roll-feed apparatus and method and, more particularly, to an easily removable roll-feed apparatus and method for a printer/plotter that does not interfere with the ability to single sheet feed the printer/plotter.

2. Description of the Related Art

Computer driven printer/plotters, particularly those designed for producing engineering or other large drawings on paper, vellum, film or other printing media is well known. Typically, the media may have a width of from 8½ inches to as much as 3 or 4 feet or more.

With reference to a three-dimensional coordinate, the paper or other printing media is drawn through the printer in the X-direction and a thermal inkjet printer cartridge is mounted for movement in a transverse direction to the path of the paper. This is frequently called the Y-direction. A sheet of paper or other printing media is either manually fed to the plotter or media is drawn into the printer/plotter from a supply roll. For example, the Hewlett-Packard Company located in Palo Alto has three lines of such printer/plotters, designated HP DesignJet 750C, HP DesignJet 755CM and HP DesignJet 600. These printer/plotters offer top performance and fully unattended operation. These printer/plotters also include built-in provisions for the roll-feed of printing media. However, Hewlett-Packard, for example, also produces less expensive printer/plotters for more budget conscious customers, and these do not have built-in roll-feed devices. For example, Hewlett-Packard has two models, Designjet 250C and DesignJet 230 which are very affordable and offer excellent printing quality in an inexpensive package. However, neither of these two printer/plotters include roll-feed capability.

BRIEF SUMMARY OF THE INVENTION

The absence of a simple roll-feed apparatus attachment for budget conscious consumers has been resolved by the present invention which provides a removable roll-feed apparatus and method that may be used with low cost printer/plotters without interfering with the normal operation of these printer/plotters. What is disclosed is a removable roll-feed apparatus for a printer/plotter comprising a support; a horizontally disposed shaft mounted to the support, the shaft for mounting a roll of media; two oppositely disposed and horizontally positioned pins connected to the support, one of the pins being movable between a disconnected mode and a connected mode; the pins for positioning the support in relation to the printer/plotter in a direction parallel to a first axis; a first surface on the support for positioning the support relative to the printer/plotter in a direction parallel to a second axis; and a second surface on the support for positioning the support relative to the printer/plotter in a direction parallel to a third axis.

A method is also disclosed for mounting a roll-feed apparatus on a printer/plotter comprising the steps of providing a shaft for mounting a roll of media, the shaft being supported by first and second side frame members; providing first and second pins, the first pin connected to the first frame member and the second pin connected to the second frame member; connecting the second pin to the second frame member so as to be movable between extended and retracted positions; providing a connector for attaching the frame member to the printer/plotter; connecting the first pin to the printer/plotter; pivoting the shaft and frame members to cause alignment with the printer/plotter; connecting the second pin to the printer/plotter; rotating the shaft and frame members toward the printer/plotter using the first and second pins as an axis; and engaging said printer/plotter with said connector to constrain movement of the shaft and frame members in a direction parallel to a first axis.

An object of the present invention is to provide a removable roll-feed apparatus which is relatively inexpensive, easy to install and easy to use. Another aim of the present invention is to provide a removable roll-feed apparatus that does not interfere with the ability to feed individual sheet media to the attached printer/plotter. A further aspect of the present invention is to provide a removable roll-feed apparatus that does not require any particular degree of training or dexterity to use. Another advantage of the present invention is to provide a roll-feed method that is simple, reliable and yet low cost.

A more complete understanding of the present invention and other objects, aspects, aims and advantages thereof will be gained from a consideration of the following description of the preferred embodiment read in conjunction with the accompanying drawings provided herein.

DESCRIPTION OF THE PREFERRED EMBODIMENT

Figure 1:
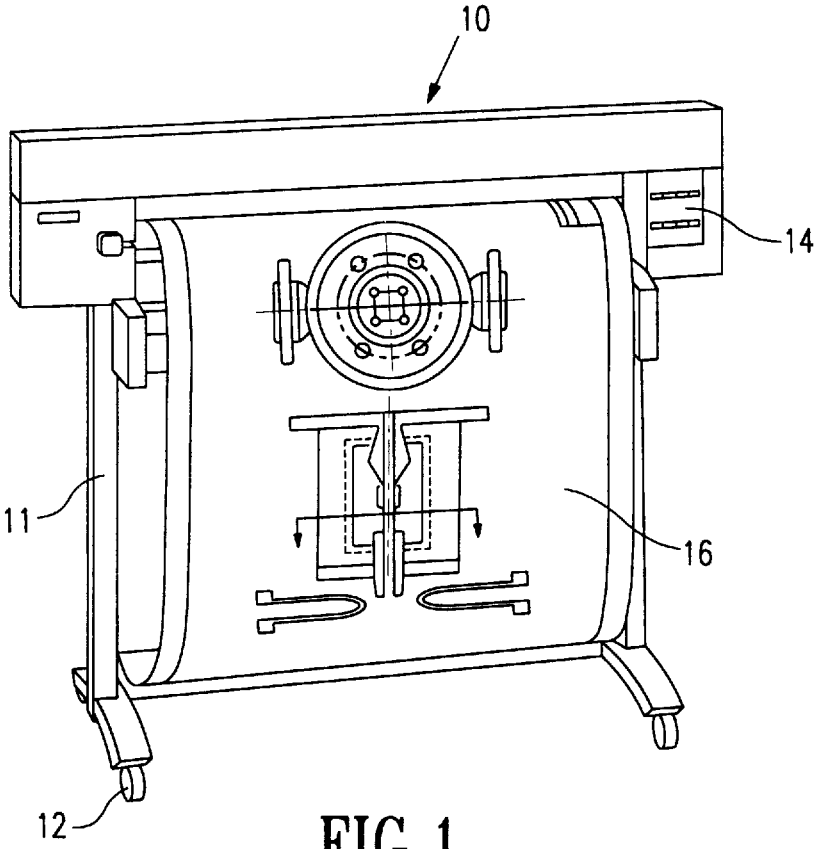
FIG. 1 is a front pictorial view of a printer/plotter to which a roll-feed apparatus may be connected.

While the present invention is open to various modifications and alternative constructions, the preferred embodiments shown in the drawings will be described herein in detail. It is to be understood, however, that there is no intention to limit the invention to the particular form disclosed. On the contrary, the intention is to cover all modifications, equivalences and alternative constructions falling within the spirit and scope of the invention as expressed in the appended claims.

The invention of the present application operates in conjunction with a printer/plotter 10, FIG. 1, which in order to carry the roll-feed of the present invention must be supported by a set of legs 11 (and optional rollers 12). It may be positioned to rest on a table (not shown), if the roll-feed is not added. The plotter includes a control panel 14 having operating switches and lights to indicate its status. For illustrative purposes, hanging from the plotter is a media segment 16 such as paper, vellum or film which has just exited from the printer. Printer/plotters of the type illustrated may be purchased from Hewlett-Packard, under model designations, Design Jet 250C and Design Jet 230. These printer/plotters use inkjet technology to produce vibrant full color or black and white outputs in dimensions large enough to handle E size prints.

Figure 2:
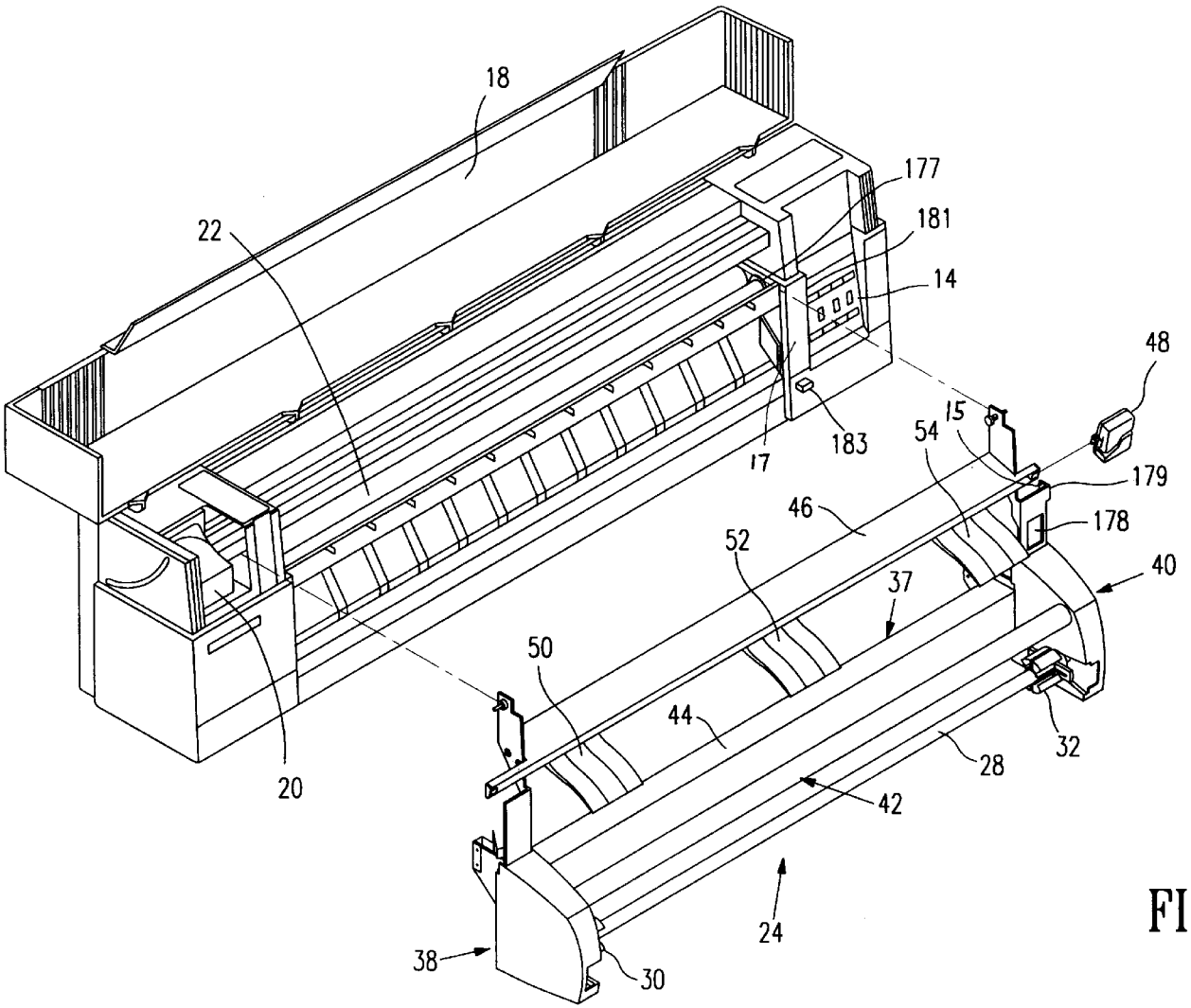
FIG. 2 is a exploded front pictorial view of the printer/plotter and the roll-feed apparatus.

As shown in more detail in FIG. 2, the printer/plotter has a cover 18 which is shown in its open position in FIG. 2 and in its closed position in FIG. 1. Within the printer is a thermal inkjet cartridge 20 mounted on rods to allow the cartridge to move back and forth across a rotatable platen roller 22. Media moves around the platen in what can be termed the X-direction while the print cartridge moves across the media in the Y-direction.

The Hewlett-Packard printer/plotters of the type just described are relatively inexpensive and are marketed to budget-conscious consumers. Thus, the printer/plotters are simple and are intended to have media sheets fed one at a time through the printer. It is intended here, however, to describe a roll-feed apparatus which may be removably attached to the printer/plotter at the determination of an operator to allow the option of feeding the printer/plotter from a roll of media. The roll-feed apparatus is relatively light in weight, easy to install and remove, and rugged in design.

Figure 3:
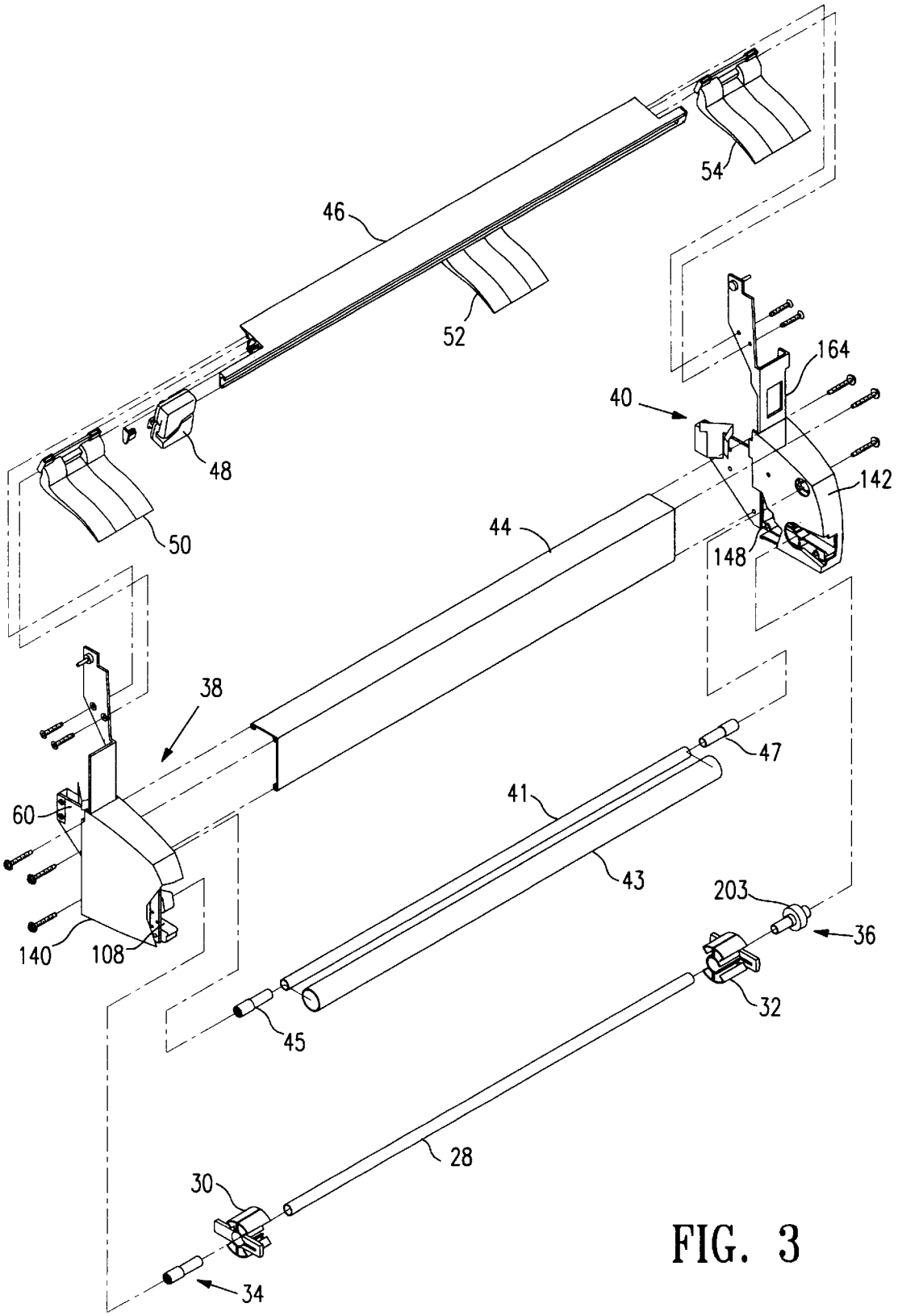
FIG. 3 is a fully exploded front pictorial view of the roll-feed apparatus.
Figure 4:
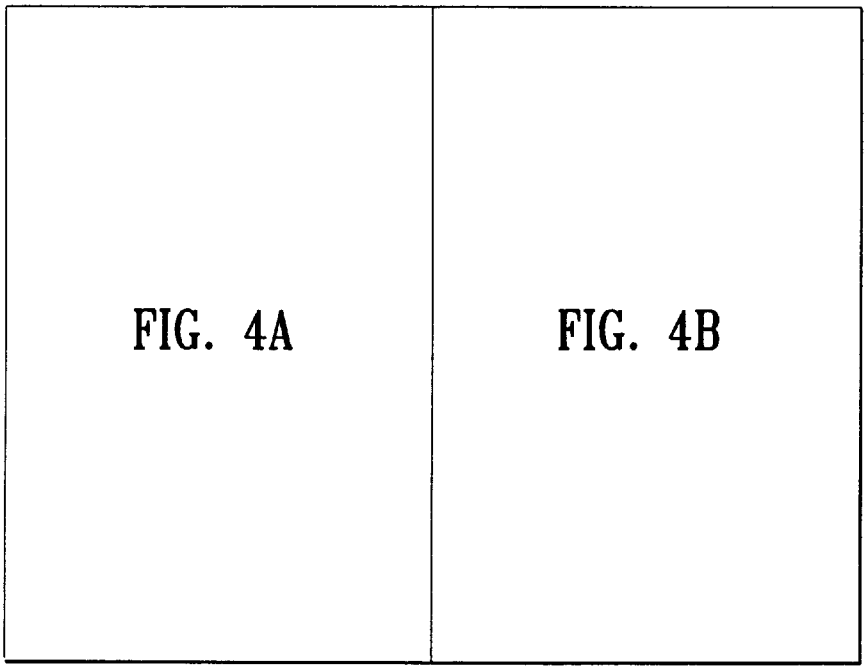
FIG. 4 is an enlarged exploded front pictorial view of a frame assembly of the roll-feed apparatus.
Figure 4A:
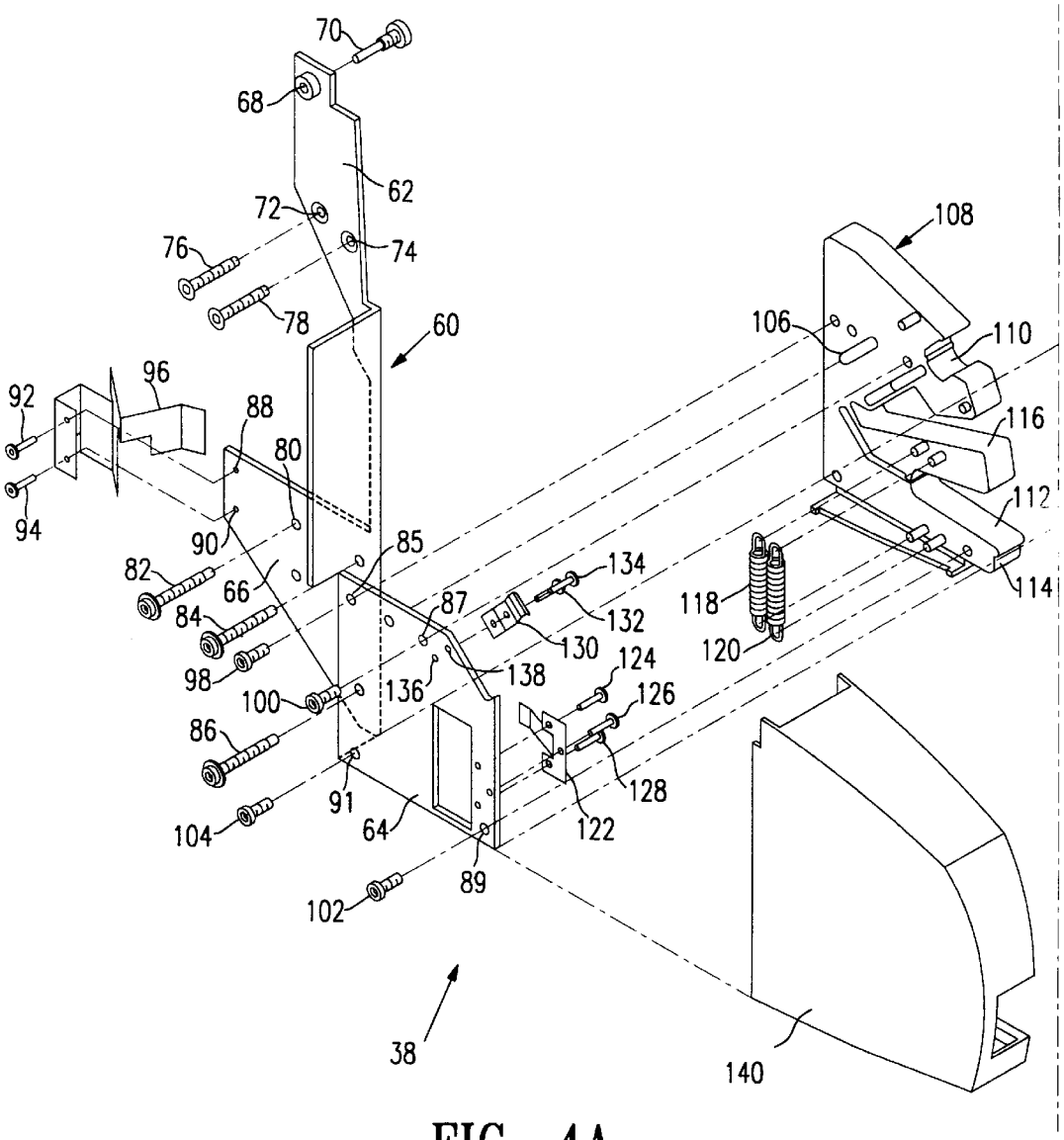
Figure 4B:
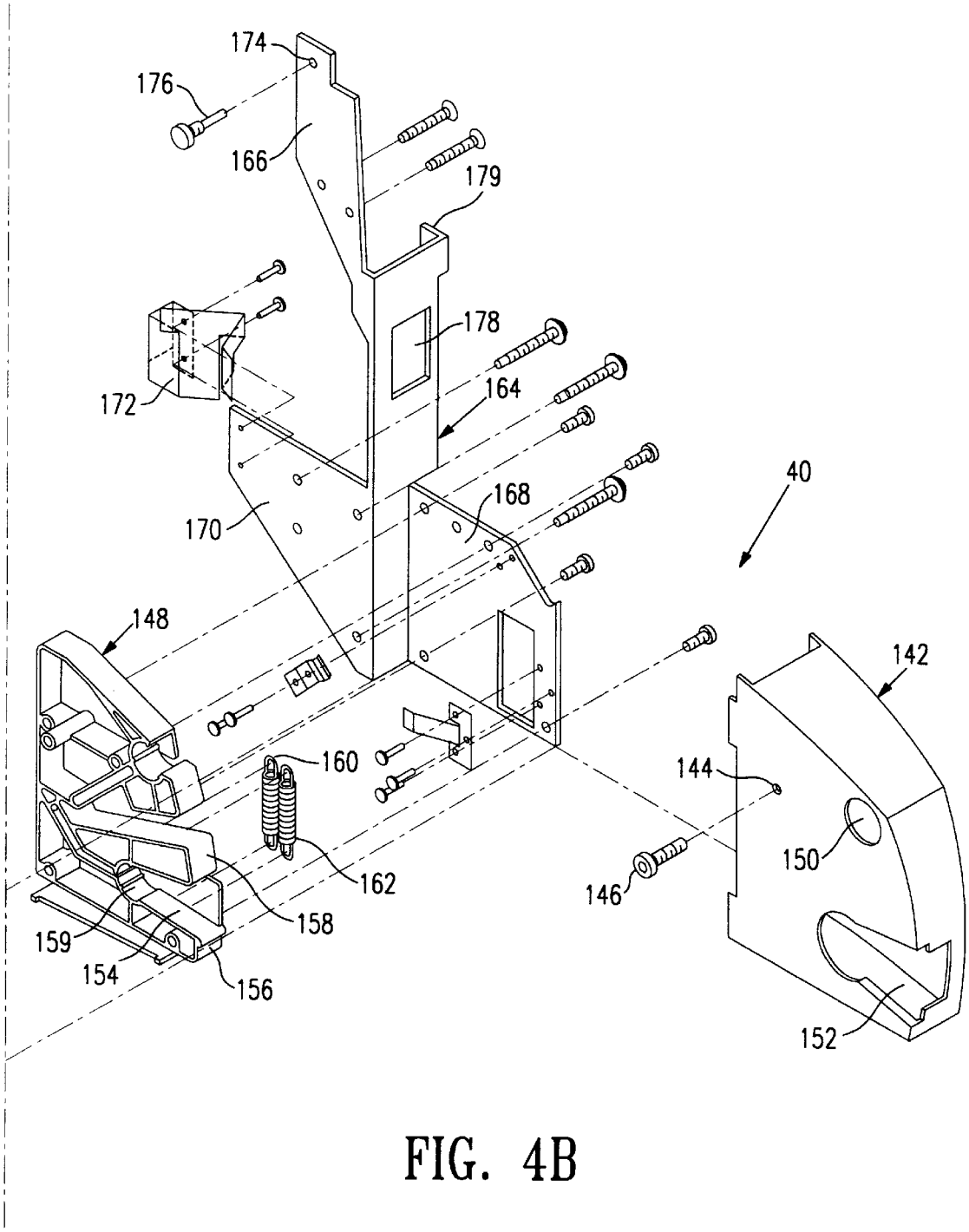

Referring now to FIGS. 2, 3 and 4, the removable roll-feed apparatus 24 is described in detail. As mentioned, a primary advantage of the removable roll-feed apparatus is that the printer/plotter may be fed either with sheet media or with media from a large roll even when the roll-feed apparatus is attached. The removable roll-feed apparatus comprises means for mounting a roll of media such as a shaft 28, first and second hub attachments 30 and 32 and first and second end caps 34 and 36. The shaft, hub attachments and end caps are mounted to a supporting means such as a frame assembly 37 having left sub-assembly 38 and right sub-assembly 40 on each side of the media mounting means. Also part of the frame assembly is a diverter roller 42 which is disposed generally parallel to the shaft 28. The diverter roller includes a shaft 41, a foam cover 43 and left and right end caps 45 and 47. Also included in the frame assembly is an L shape stiffening element 44. The stiffening element is disposed parallel to the diverter roller 42 and the shaft 28 and is attached to the left and right sub-assemblies.

Also connected to the frame sub-assemblies 38 and 40 is a guide rail 46 for supporting a cutting apparatus 48 first, second and third and media deflector panels 50, 52 and 54.

Figure 5:
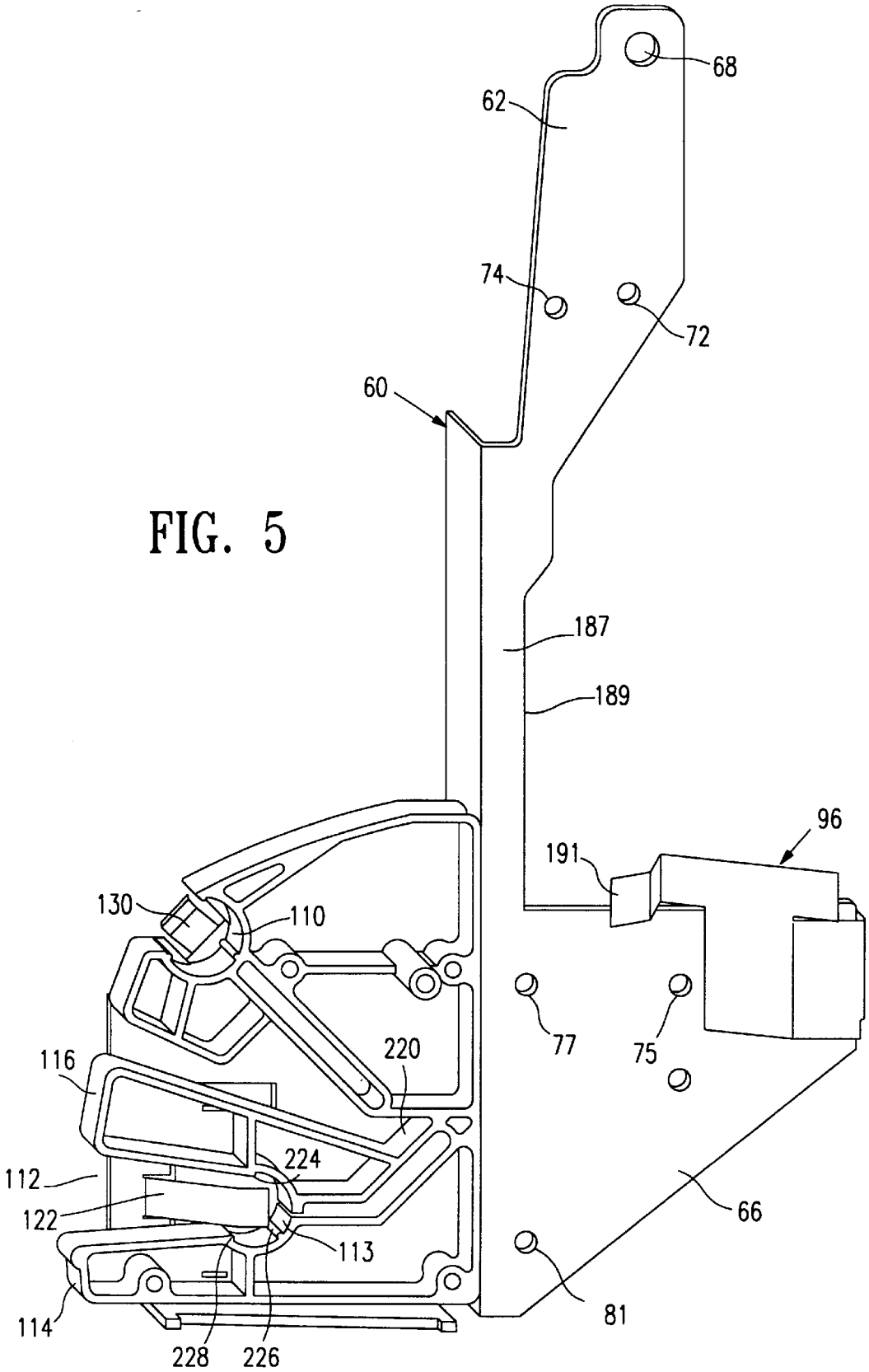
FIG. 5 is an enlarged reverse front pictorial view of a portion of the left frame sub-assembly of the roll-feed apparatus.

The frame sub-assemblies are shown in greater detail in the exploded views of FIGS. 3 and 4 and the pictorial view of FIGS. 5. The left side frame sub-assembly includes a stamped metal bracket 60 having a first upwardly extending arm 62, a forwardly extending base 64 and a rearwardly extending base 66. A first opening 68 is provided in the arm 62 to receive a first partially threaded pin 70. Second and third openings, 72 and 74, are formed in the arm 62 to accommodate first and second screw fasteners 76 and 78. Fourth, fifth and sixth openings, 75, 77 and 81 are formed in the rearward base. Openings 75, 77 and 81 receive first, second and third threaded fasteners 82, 84 and 86 which are used to fasten the stiffening element 44. At the extended end of the rearward base are seventh and eighth openings 88 and 90 to receive first and second rivets 92 and 94 which are used to attach a first spring steel clip 96 to the rearward base. Ninth, tenth, eleventh and twelfth openings 85, 87, 89 and 91 are formed in the forward base.

Figure 6:
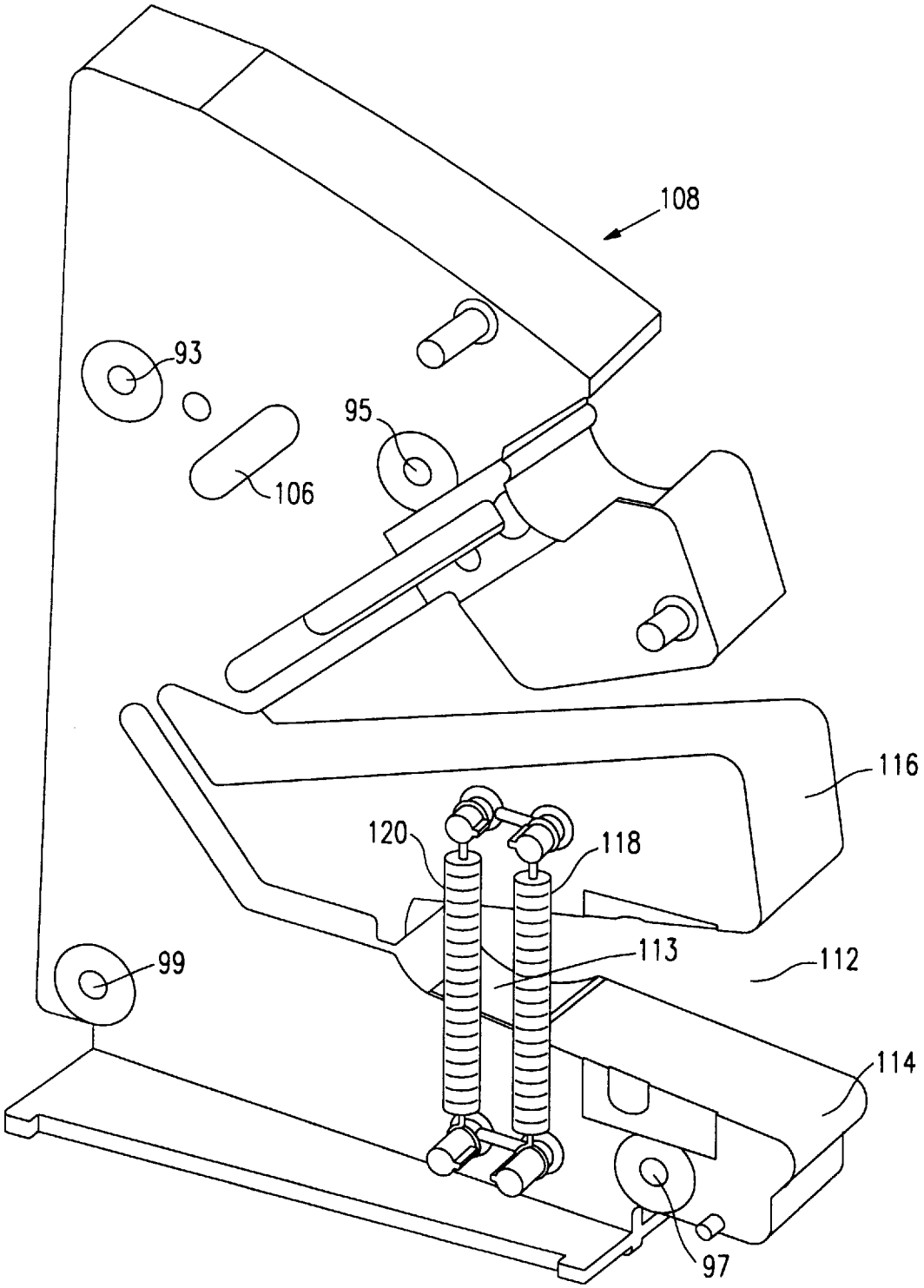
FIG. 6 is an enlarged front pictorial view of a right side plastic support bracket of the roll-feed apparatus.
Figure 7:
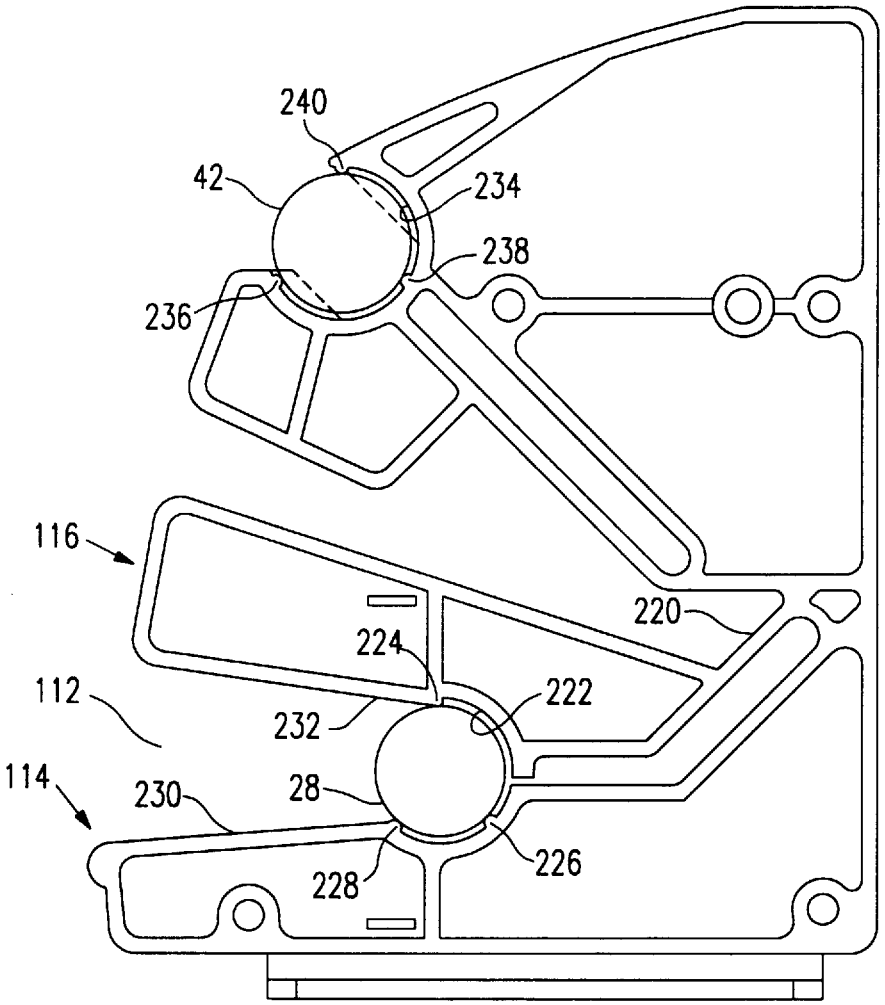
FIG. 7 is an enlarged side elevation view of a left side plastic support bracket of the roll-feed apparatus.

Referring now to FIGS. 4, 5 and 6, a first molded plastic support bracket 108 is mounted to the forward base 64 by first, second, third and fourth screws 98, 100, 102 and 104 (received by the ninth, tenth, eleventh, twelfth openings 85, 87, 89 and 91, respectively) and a guide pin 106. The support bracket includes thirteenth, fourteenth, fifteenth and sixteenth threaded openings 93, 95, 97 and 99 to receive the first, second, third and fourth screws 98, 100, 102 and 104, respectively. The support bracket 108 includes a rounded recess forming a bearing 110 for receiving an end cap 45 of the diverter roller, and an elongated slot 112 terminating in a bearing 113 for receiving the end cap 34 of the media shaft. The media shaft is typically called a spindle assembly. The slot and bearing is formed by a lower fixed arm 114 and an upper pivotal arm 116. The pivotal arm 116 is connected to ends of first and second coil springs 118 and 120. The other ends of the coil springs are connected to the arm 114. In this way the arm 116 may be pivoted from its "at rest" position upwardly to allow receipt of the media shaft. When the shaft is mounted in the bearing 113 the upper arm pivots to a closed position under the influence of the two coil springs as shown in FIG. 7.

Also attached to the forward base is a second spring metal clip 122 for providing a biasing force against the media shaft in a direction parallel to its longitudinal axis. The clip 122 is connected to the forward base by third, fourth and fifth rivets 124, 126 and 128. A third spring metal clip 130 is connected adjacent the bearing 110 to provide a biasing force on the diverter roller parallel to its longitudinal axis. Third and fourth rivets 132 and 134 are used as fasteners. These rivets are received by seventeenth and eighteenth openings 136 and 138 in the forwardly facing base 64. A molded plastic cover 140 is provided to envelop the support bracket 108, forward base 64 and associated fasteners, springs and clips.

The right frame sub-assembly 40 is primarily a mirror image construction of the left frame sub-assembly. Referring to FIG. 4, a plastic cover 142 envelops a second support bracket 148, a forward base 168 of a stamped metal bracket 164 and accessory items described below. The cover has an opening 144 to receive a screw 146 that attaches the cover to the right side plastic support bracket 148. In order to assemble the covers and plastic support brackets, the cover will be slid on the roll-support guide (see the ribs on the bottom). The cover 142 also includes an opening 150 to receive the end cap 47 of the diverter roller and an elongated opening 152 aligned with an elongated slot 154 that is a mirror image of the slot 112. The slot 154 is formed by a fixed arm 156 of the support bracket and a pivotal arm 158. The slot 154 terminates with a bearing 159. Third and fourth coil springs 160 and 162 connect the two arms 158 and 156 so as to allow the movable arm 158 to pivot upwardly during the insertion of the media shaft and to lock the end cap 36 and thereby the shaft 28 in place when the arm pivots downwardly.

The right frame sub-assembly also includes the bracket 164 which is a close mirror image of the bracket 60 but not exact in all respects. The bracket 164 includes an arm 166, a forwardly extending base 168 and a rearwardly extending base 170. A fourth spring steel clip 172 is attached to the rearward base 170 in the same manner as was described for the clip 96 and the rearward base 66. In a like manner, the support bracket 148 is connected to the forward facing base 168 in the same fashion as already described for the left frame sub-assembly. An opening 174 is provided at the upper end of the arm 166 through which a second threaded pin 176 is attached. The bracket 164 differs from its sister bracket due to an opening 178, to accommodate the printer/plotter on/off switch 183, and a rearward extending flange 179. These features are not found on the bracket 60.

Two more differences between the left and right frame sub-assemblies are the absence of biasing clips on the right sub-assembly analogous to the clips 122 and 130 on the left subassembly. They have been replaced by two fixed reference points in the plastic part on the right end.

In the preferred embodiment, the material of the brackets 60 and 164 is stainless steel, the first, second and third deflectors 50, 52, 54 are made of injection molded ABS, the cutter track is extruded aluminum, the stiffener is also extruded aluminum, the first and second covers 140, 142 are injection molded ABS, the first and second plastic support brackets 108, 148 are injection molded PC+20%GF, the first and second end caps 34, 36 are injection molded POM+20%PTFE, the left and right end caps 45, 47 are PPO+20%CF+159PTFE, the coil springs are stainless steel providing a force of 25N, the first, second, third and fourth spring clips 96, 122, 130, 172 are stainless steel, the diverter shaft and media shaft are standard steel tubing, the cover 43 is EPDM, and the hubs are injection molded polycarbonate.

The removable roll-feed apparatus is assembled by riveting the first, second and third spring clips 96, 122 and 130 to the bracket 60. In a like manner, the fourth clip 172 is riveted to the bracket 164. The first and second plastic supports brackets 108 and 148 are also attached to their respective forward bases 64 and 168 by their respective threaded fasteners. The first and second coil spring 118 and 120 are attached to the first and second arms 114 and 116 and in a like manner the first and second coil springs 160 and 162 are attached to the third and fourth arms 156 and 158. The first and second threaded pins 70 and 176 are attached to the arm 62 and 166, respectively, and the covers 140 and 142 are slid together and then fastened to the respective plastic support brackets 108 and 148 by threaded fasteners.

The left and right frame sub-assemblies are mounted about the diverter roller and then fastened to opposite ends of the stiffener element 44 and the guide rail 46 by threaded fasteners. The cutter 48 is mounted to the guide rail as are the diverter panels so that each may slide along the guide rail in the Y-direction.

The roll-feed apparatus 24 may be installed or removed from a printer/plotter at the convenience of the operator. In either mode, the operator is able to feed single sheet media to the printer/plotter without interference from the roll-feed apparatus.

The roll-feed apparatus has four datum location used to precisely position the roll-feed apparatus relative to the printer/plotter. Two of the datum are defined by the pins 70, 176 located at the upper arms of the brackets 60, 164.

Installation of the roll-feed apparatus may begin by having the right pin 176 in place in the right bracket. The operator then aligns the roll-feed apparatus so that the pin is received by an opening 177, FIG. 2 formed in the housing of the printer/plotter. Then the left side of the roll-feed apparatus is pivoted into position using the pin 176 as a pivot point, so that the opening 68 at the top of the bracket is aligned with an opening (not shown) in the housing of the printer/plotter. The pin is inserted into the opening 68 and into the opening in the printer/plotter housing.

Figure 8:
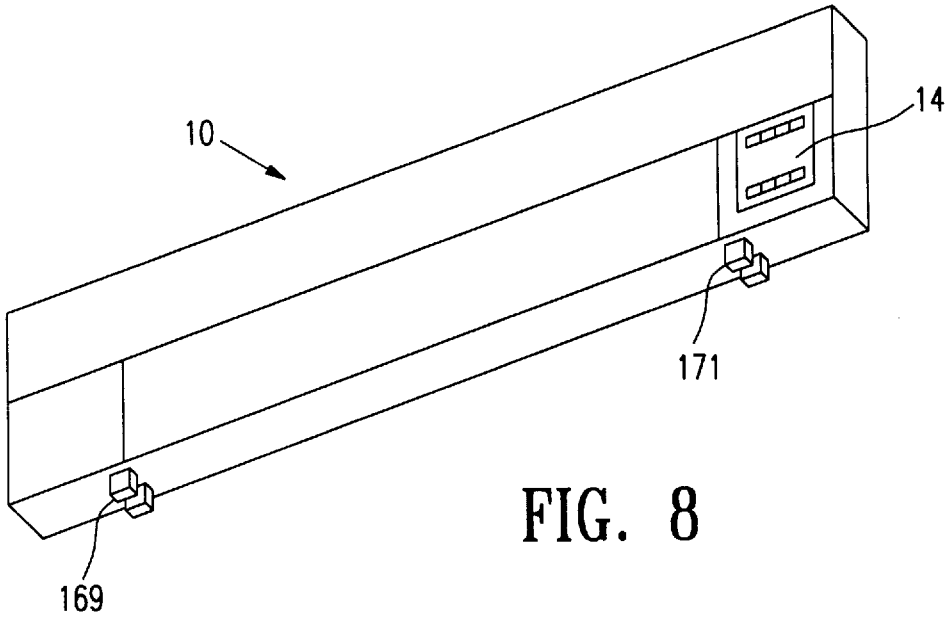
FIG. 8 is a bottom front pictorial view of the printer/plotter showing its feet for use with a table top.
Figure 9:
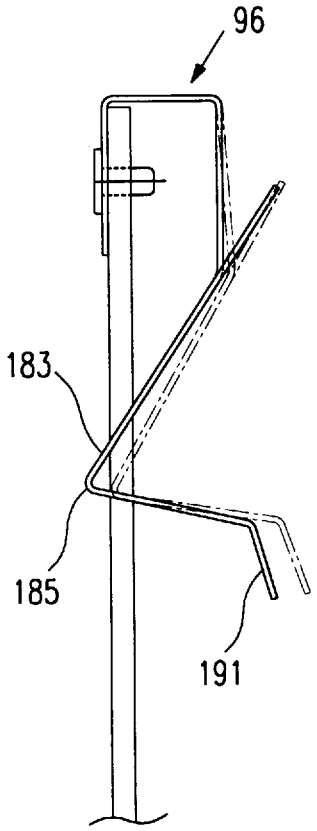
FIG. 9 is a top plane view of the left side spring clip showing its at rest and pivoted positions.

With the two pins 70, 176 defining an axis of rotation, the roll-feed apparatus is pivoted downwardly toward the plotter to enable the spring clips 96, 172 to engage front feet 169, 171, FIG. 8 of the printer/plotter. The feet which are generally cylindrical in shape become cam surfaces that operate on the spring clips 96, 172 which provide cam follower surfaces, such as surface 183, FIG. 9 of the clip 96. The camming action pivots the spring clips from their at rest position, shown in solid line in FIG. 9, to an extended position, shown in phantom line, while the roll-feed apparatus is pivoted toward the printer/plotter. Once edges of the spring clips, such as the edge 185, clear the legs, the inherent biasing force of the spring clips will return them to their at-rest position, thereby constraining the roll-feed apparatus from moving without operator assistance.

Two datum surfaces are also provided to insure that the roll-feed apparatus is properly located. First, a flange 187 FIG. 5 on the bracket 60 has an edge surface 189 that will abut the front surface 17 of the housing of the printer/plotter. This abutment of flange and housing locates the roll-feed apparatus in the X-direction. Second, a surface 15 of the flange 179 on the bracket 164 engages side wall surface 181, FIG. 2 of the printer/plotter, and their abutment establishes the location of the roll-feed apparatus in the Y-direction. The pins 70, 176 establish the position of the roll-feed apparatus in the Z-direction. Thus, as can be seen, the roll-feed apparatus is located in front of and below the printer/plotter.

While the description of the datum location and the method of installing the roll-feed apparatus onto the printer/plotter was lengthy, the actual process is quite quick, relatively easy and does not require any special dexterity on the part of the operator.

Once the roll-feed apparatus is positioned on the printer/plotter the operator has the choice of feeding the plotter with roll media or sheet media. The roll-feed apparatus does not interfere with single sheet feeding of the printer/plotter.

Removal of the roll-feed apparatus is just as easy as its installation. First, the operator grips the flanges on the spring clips, such as flange 191, FIGS. 5 and 9 on the clip 96, and pivots the clips to their expanded positions while the bottom portion of the roll-feed apparatus is pivoted away from the printer/plotter by the operator. The operator may then release the clips, and while supporting the roll-feed apparatus, he or she retracts the left pin. Once the left pin has cleared the opening on the left side of the housing, the roll-feed apparatus may then be pivoted using the pin 176 as an axis of rotation. After several inches the roll-feed apparatus is clear of the left side of the printer/plotter and the apparatus may then be moved leftwardly in a linear direction removing the pin 176 from the opening 177. Once that is accomplished, the roll-feed apparatus is clear of the printer/plotter and it may then be placed in storage.

Figure 10:
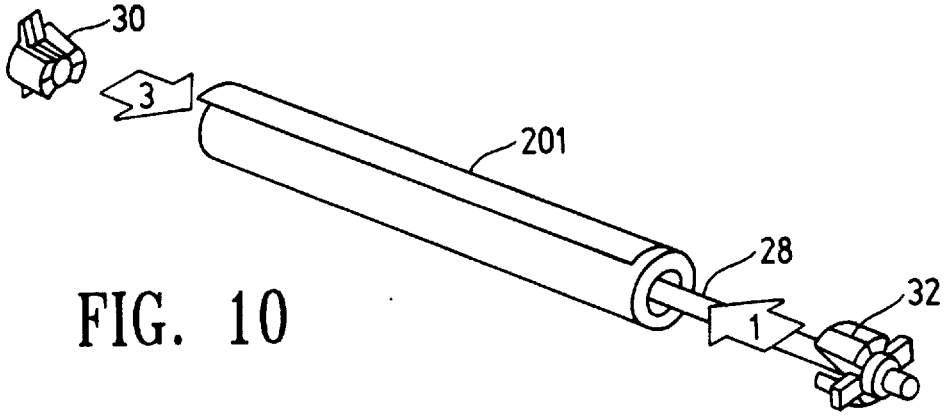
FIG. 10 is a reversed exploded front pictorial view of a media roll on a shaft.
Figure 11:
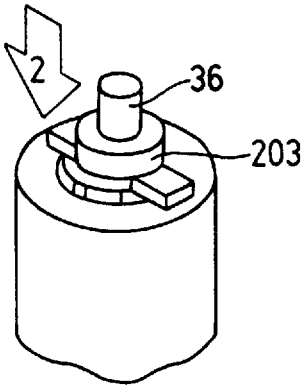
FIG. 11 is a pictorial view of the media roll rotated 90°.
Figure 12:
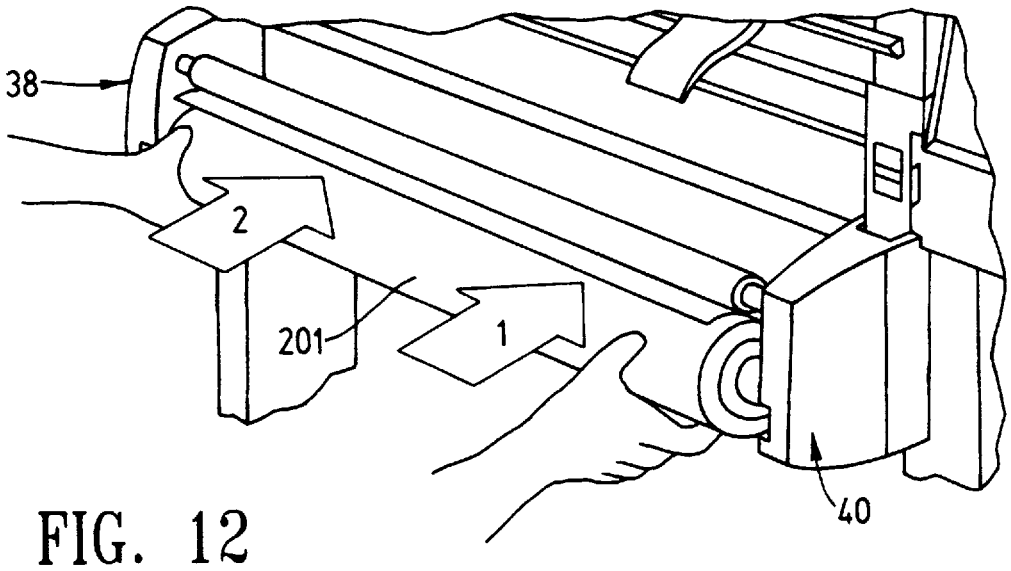
FIG. 12 is a reversed front pictorial view of the media roll being installed on the roll-feed apparatus.

Referring to FIGS. 10, 11 and 12, the method for loading a roll of media onto the roll-feed apparatus is illustrated. The method comprises removing a fresh roll from it wrapping and then placing the roll 201 on the shaft 28. Prior to placing the new roll of media on the shaft, the right side hub 32 has already been mounted to the shaft and pushed rightwardly until the hub engages a collar 203 on the end cap 36 which limits further rightward movement. As explained in copending application Attorney Docket #6096027 entitled, ADJUSTABLE SPINDLE ASSEMBLY FOR ROLL-FEED MEDIA IN AN INKJET PRINTER/PLOTTER, Ser. No. 08/639,571, filed on 29 Apr. 1996 in the names of Antonio Hinojosa et al., the collar includes two spaced guided elements which are received by appropriate openings in the hub. These locate the hub circumferentially around the shaft and cause the hub to "snap" into position and be removably locked. The new media roll is then placed such that the hub 32 may be is pushed into the core tube of the roll. Thereafter, the left side hub is mounted to the shaft and pushed rightwardly until it too engages the new media roll.

The roll is then gripped by an operator so that the shaft journals (the end caps) are engaged with the elongated slots of the support brackets 108, 148. First, the operator pushes the right side of the roll until the end cap 36 "snaps" into the bearing 159 and then the left side is pushed until the end cap 34 "snaps" into the bearing 113. As previously described, the shaft will move along the slots, engage the movable arms, first on the right and then on the left, and a camming action will occur pivoting the movable arms upwardly until the shaft has situated itself in the bearings. The pivotal arms then snap back under the influence of the coil springs and thereby lock the shaft into position.

After the end cap 34 is placed in its bearing, the shaft will come under the influence of the clip spring 122 which will bias the shaft rightwardly to insure that the end cap 36 is engaged and properly referenced with an inner wall 149 of the support bracket 148. In this way the media roll is properly located.

Figure 13:
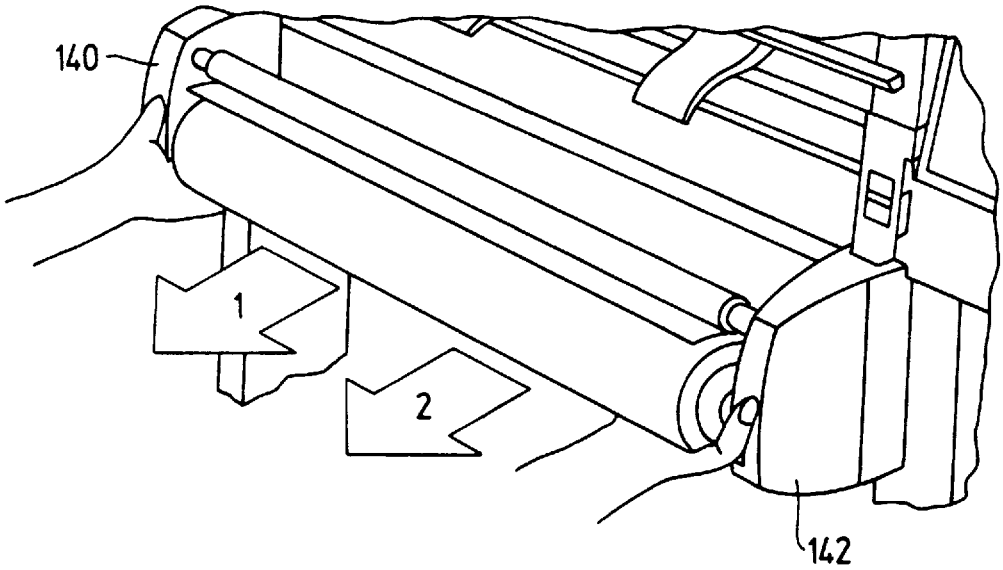
FIG. 13 is a reversed front pictorial view of the media roll being removed from the roll-feed apparatus.
Figure 14:
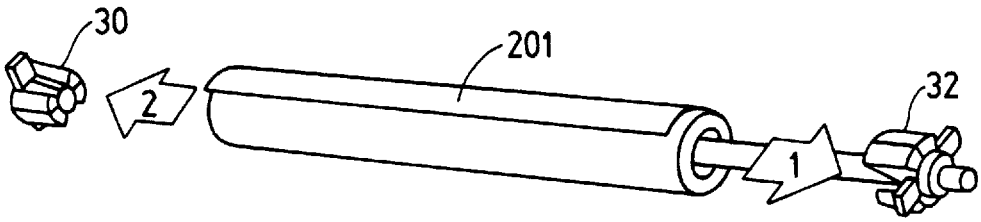
FIG. 14 is a reversed exploded front pictorial view of the media roll being removed from the shaft.

Removing a partially used media roll or the core tube of a completely used roll of media begins by removing the media roll shaft 28 from the roll-feed apparatus. See FIGS. 13 and 14. This is done by having an operator push with his or her thumbs against the covers 140, 142 while the remainder of each hand curls around the media roll or core tube and pulls first on the left end of the shaft and then on the right. This causes the end caps to cam the pivot arms 116, 158 to an open position thereby allowing the shaft to be withdraw. Once the shaft has been removed from the roll-feed apparatus, the left hub 30 is removed from the shaft by sliding it leftwardly and then the core tube or media roll 201 is removed from the shaft. The right side hub 32 remains in its locked position.

Figure 15:
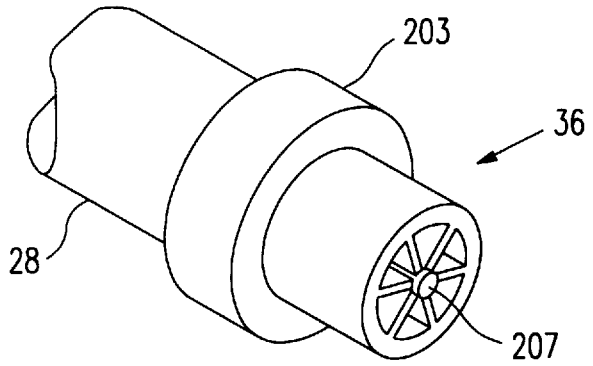
FIG. 15 is an enlarged pictorial view of a right end cap of the roll shaft.
Figure 16:
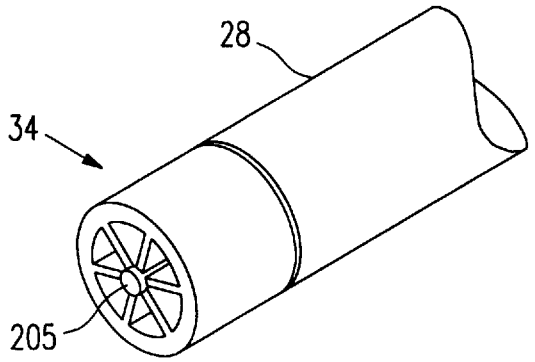
FIG. 16 is an enlarged pictorial view of a left end cap of the roll shaft.

Referring now to FIGS. 15 and 16, there is illustrated in more detail, the end caps 34 and 36. Each of the end caps are press fitted to the ends of the shaft 28 to form journals that rotate within the bearings 113 and 159. At the ends of each end cap is a small projection, projection 205 on the end cap 34 and projection 207 on the end cap 36, which serve to provide low friction bearing surfaces.

Another major advantage of the roll-feed apparatus is that a predetermined amount of friction is built into the system to create a "back tension". This means that the mechanism is not designed to have as little friction as possible. On the contrary, the roll-feed apparatus induces a drag on the media so that there is always a need for the plotter to "pull" the media. Indeed, when the printer/plotter is stopped, the media roll will also stop quickly because of the induced friction.

Two advantages are achieved with such a mechanism. First, it has been found that with a proper amount of back tension, the printer/plotter will correct a misalignment of the media after about six meters of the media has passed through the printer/plotter. Second, when the plotter stops, it is desirable that the media roll also stop so that there is no "bubble" formed in the media. In spite of the back tension, the shaft to which the media is mounted is easily inserted onto the roll-feed apparatus and just as easily removed with a small amount of force being required.

Figure 18:
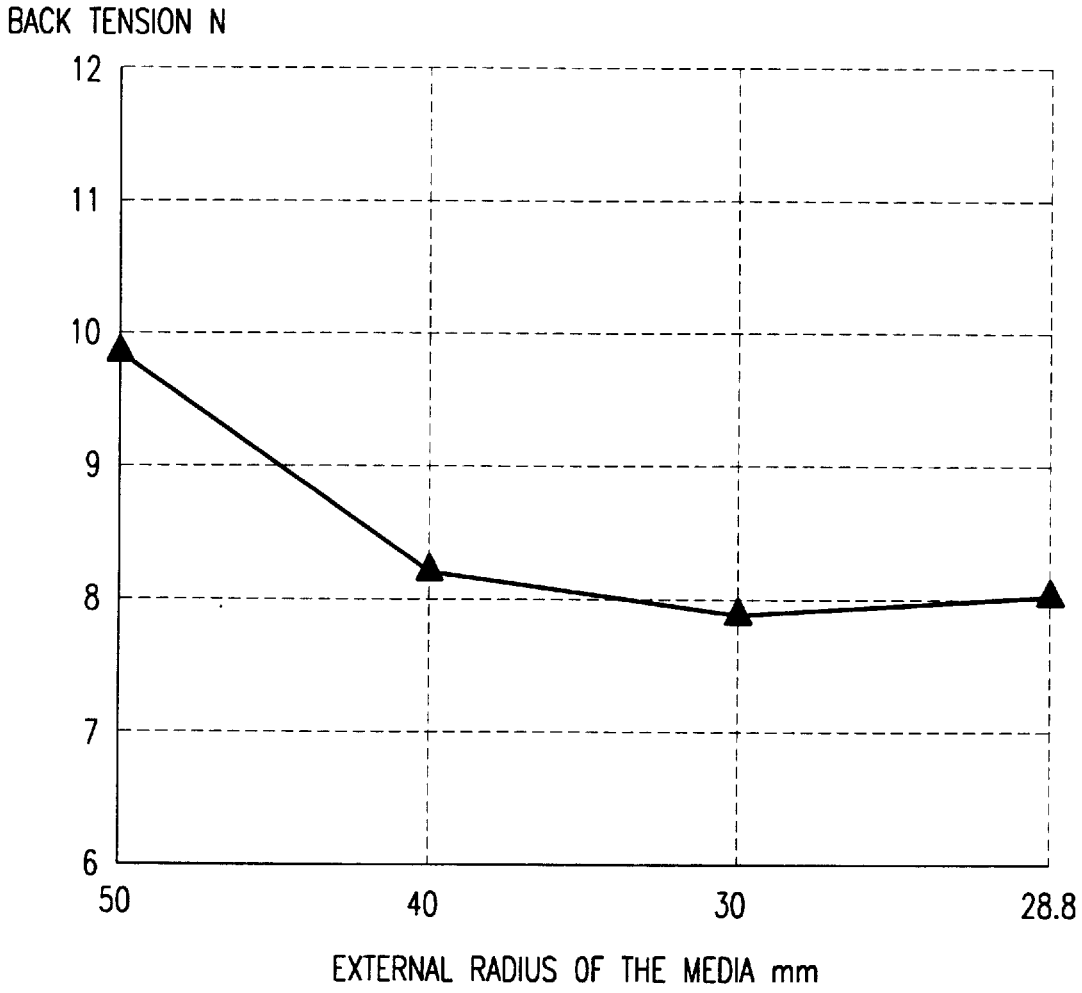
FIG. 18 is a graph plotting media roll radius and back tension force.

Referring back to FIGS. 5, 6, 7 the left support bracket 108 is shown in detail. The elongated slot 112 is formed by the fixed arm 114 at the bottom and the pivotal arm 116 above. The pivotal arm is hinged by a link 220 so that the arm is able to pivot about 0.5–0.6 centimeters. This is more than enough room to pass the shaft and allow it to be received by the bearing 113 formed between the two arms 114 and 116. Once the shaft is supported by the bearing the added friction may be induced. The inner wall 222 of the bearing includes three small ridges 224, 226 and 228. Since the two arms 114 and 116 are biased toward each other by the coil springs 118 and 120, the end cap 34 is biased against the three ridges to create the predetermined amount of friction. This friction torque is a function of the spring rate of the coil springs, the materials of the bearing and the end cap, the relative position of the contact points formed by the three ridges, and the weight of the media roll on the shaft 28. The spring rate of the coil springs is approximately 25N. The material of the end caps is POM+20%PTFE, and the material of the bearing is PC+20%GF. FIG. 18 illustrates a graph plotting the radius of the media, and thereby its weight, versus the back tension in Newtons as measured just before the entry platen.

Figure 19:
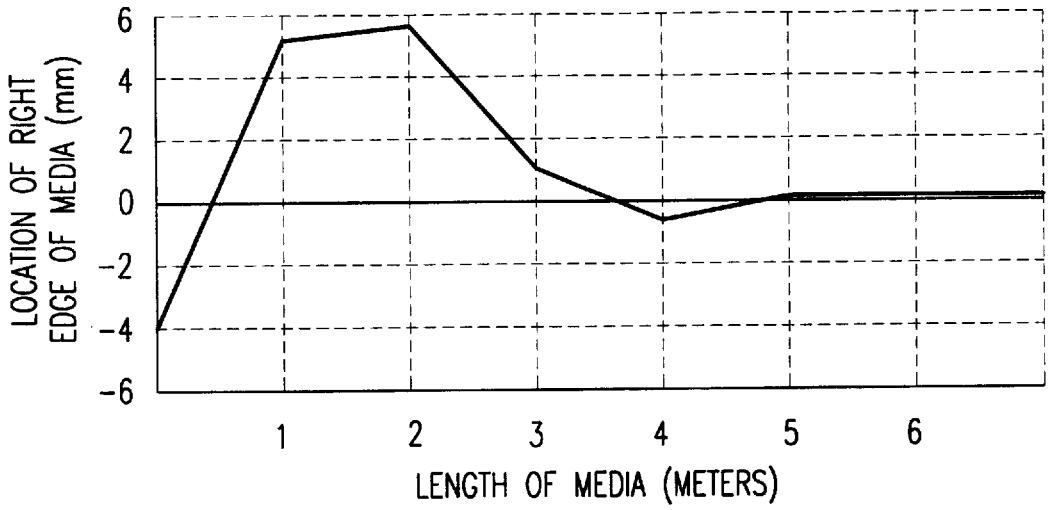
FIG. 19 is a graph plotting alignment of a media edge and the length of media needed to self correct a misalignment.
Figure 20:
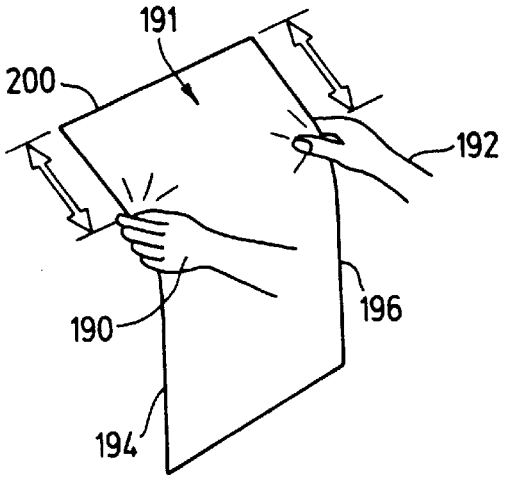
FIG. 20 is an illustration of an operator loading a sheet of media into the printer/plotter.
Figure 21:
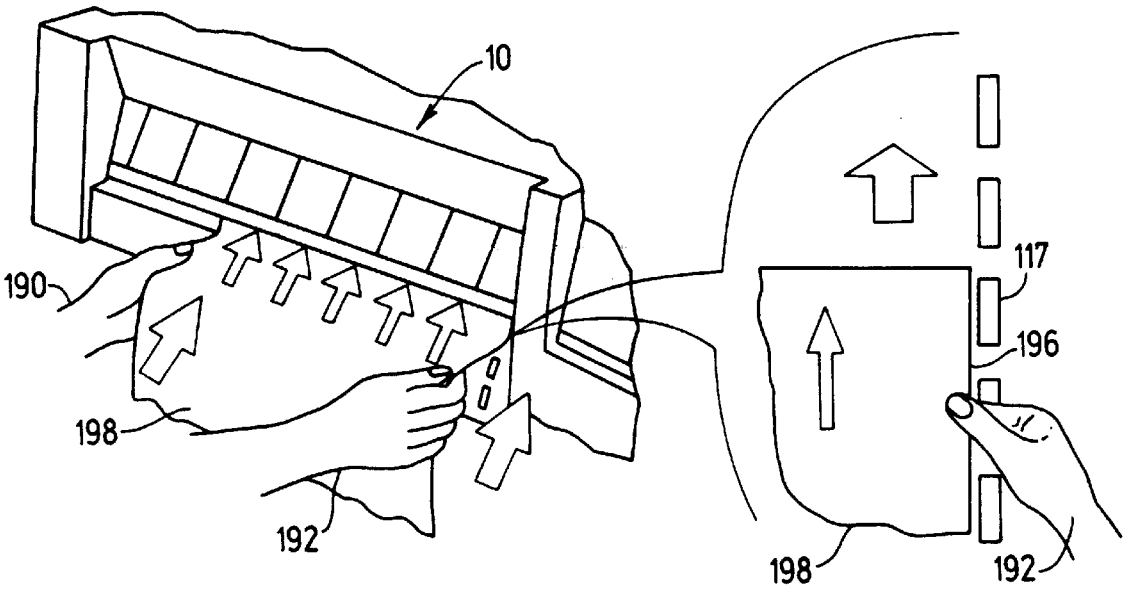
FIG. 21 is an illustration of the operator aligning a sheet of media.
Figure 22:
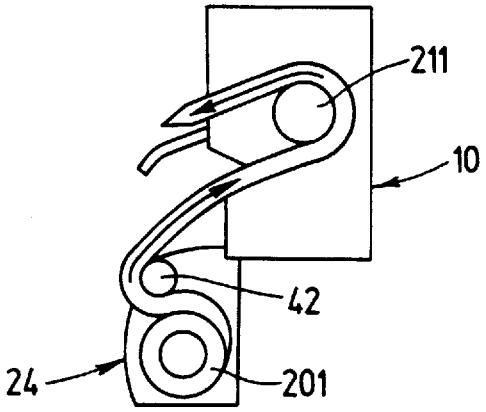
FIG. 22 is an illustration of the flow path of roll media from the roll-feed apparatus through the printer/plotter.
Figure 23:
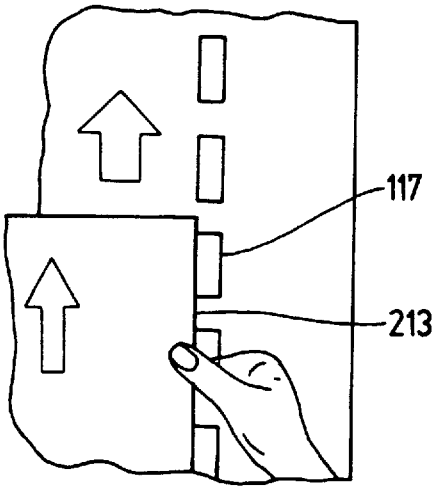
FIG. 23 is an illustration of the operator aligning roll media.

By creating a drag on rotation of the shaft 28 there is a back-tension created on the media as it is pulled through the printer/plotter. As shown in the graph of FIG. 19, if there is a misalignment of the media in the Y-direction, one edge of the media is taut, whereas the other edge is loose, wavy or, as frequently termed, bubbled. As a driver roller in the printer/plotter pulls the media it will begin its self alignment. At first, it has been found that the edges reverse themselves, in that the loose edge becomes taut and the taut edge becomes loose, and alignment is off, first on one side and then on the other. However, after another two meters of media have passed through the printer/plotter, the combination of the constant pull on the media by the driver roller and the constant back-tension on the media from the roll-feed apparatus causes the media to settle down and align itself. This alignment will continue until the end of the media roll assuming no external event occurs to disrupt the process. Normally, the media advances at a rate of four inches per second, and the media may be advanced as slow as one inch per second. Without the induced friction a drive motor need only have five Newton cms (Ncm) torque of 0.9 amps. To achieve the faster velocity and overcome the back-tension, which in the worst case scenario of material and weight is approximately 23.4 Nmm, the motor must have nine Newton cms (Ncm) torque or 1.7 amps.

Figure 17:
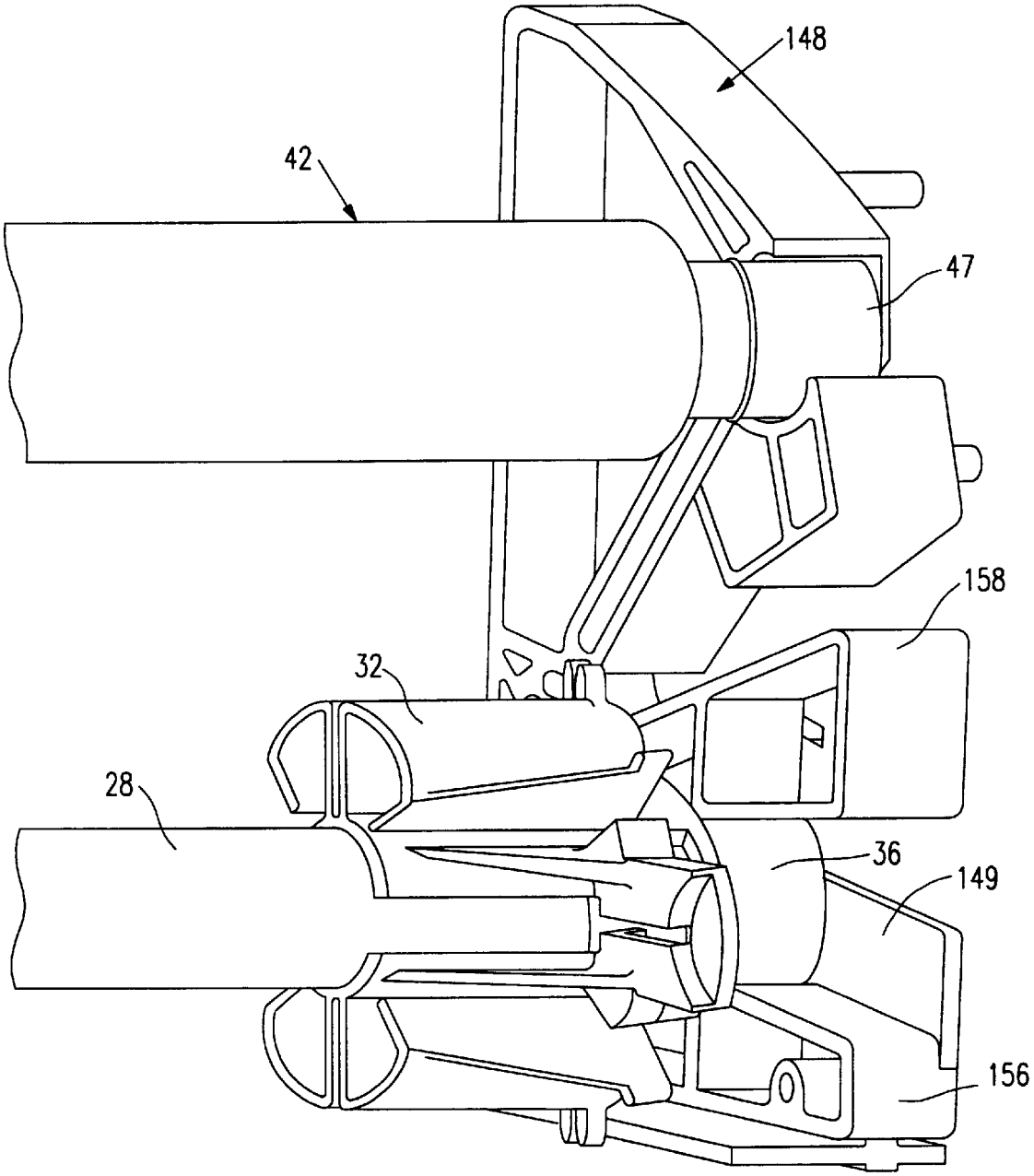
FIG. 17 is an enlarged pictorial view of the right support bracket illustrating a connection of the roll shaft and a diverter roller.

Even though the friction associated with rotation of the media has been increased, insertion and removal of the shaft and the roll of media is relatively simple and requires little effort. Referring again to FIGS. 7 and 17, the shaft 28 is inserted by sliding it relative to the top surface 230 of the lower arm 114 until the surface of the end cap engages the lower surface 232 of the upper arm 116. When that occurs the shaft acts as a cam and the surface 232 acts as a cam follower to pivot the upper arm 116 upwardly around the pivot 220. After the shaft passes the ridge 228, it "falls" into the bearing 113. Then the coil springs will bias the upper arm 116 downwardly to lock the shaft in place and provide the squeezing force to generate the desired friction.

The diverter shaft 42 is mounted in the bearing 234 and it also has three longitudinally extending ribs 236, 238 and 240. However, there is no biasing force squeezing the shaft so that friction from rotation of the diverter shaft is relatively slight. The material of the end caps and support bracket are the same as mentioned above.

The loading of sheet media and roll media is now described in relation to FIGS. 20–23. To load a single sheet of media 198, an operator, whose hands are labelled 190, 192, grips the sheet at its edges 194, 196. Before doing so, however, the operator should be sure that the cover of the printer/plotter is closed and that a media pinching mechanism is engaged. The printer/plotter is programmed with the type of media to be loaded by depressing a switch on the front panel (see FIG. 24). The operator then inserts the leading edge 200 of the sheet while placing the right edge 196 of the sheet on dashed alignment lines or slots 117 to the right of an entry platen.

To align the leading edge of the media, it is pushed against the platen until it buckles slightly as it abuts the drive roller. The drive roller will then pull the sheet into the printer/plotter. There is then a need to realign the media. A "Load Media" light on the front panel will flash until realignment is complete. The operator must next raise the cover, raise the bail and disengage the media pinching mechanism. The edges of the media exiting the printer/plotter are then aligned with the same edges entering the printer/plotter. The pinching mechanism is engaged and the leading edge is trimmed, if needed.

The procedure for loading a roll of media is essentially the same.

Figure 24:
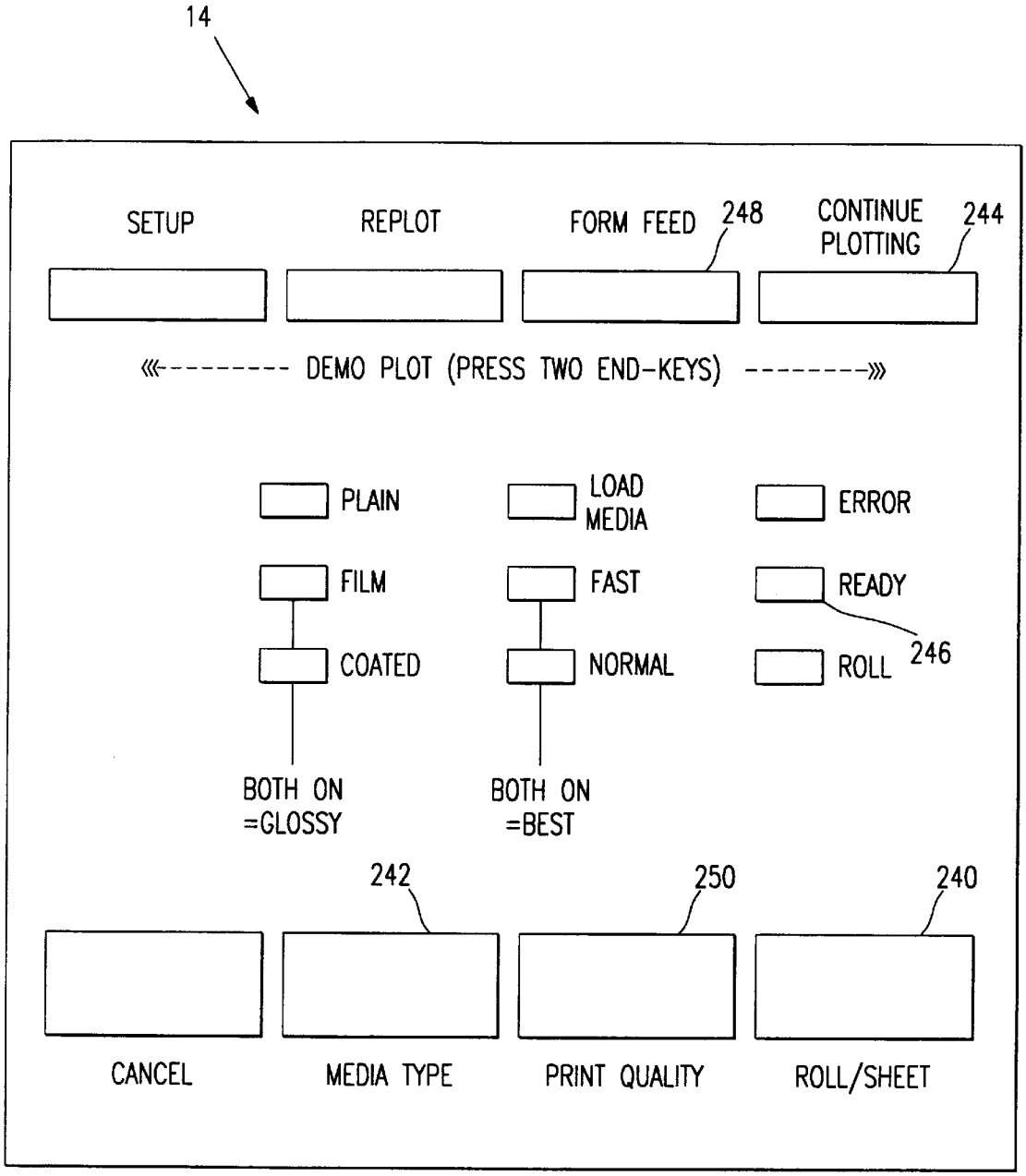
FIG. 24 is an enlarged front elevation view of a control panel of the printer/plotter.

Referring now to FIG. 24, the control panel 14 on the printer/plotter is shown in more detail. The panel has a series of control toggle switches and a series of lights which inform an operator about the status of the printer/plotter. A toggle switch 240 is provided to signal which feed is being used, either roll or single sheet. There is also a toggle switch 242 to signal the type of media being used. Toggle switch 244, labelled "Continue Plotting", is useful when the roll-feed apparatus is attached. Generally, the printer/plotter will stop after every plot to give the operator an opportunity to cut the media. Once the media has been cut, the operator presses the switch 244 to resume plotting. If the switch 244 is pressed during a plot, the printer/plotter will change to continuous plot mode, and it will not stop between plots. To indicate the status of the printer/plotter, an LED light 246 will flash when the printer/plotter is in a continuous plotting mode. To return to an automatic stop between plots, the operator need only press the switch 244 again.

A "Form Feed" switch 248 is used to eject a sheet of media and to terminate a plot. A "Print Quality" switch 250 allows an operator to print in normal, fast or slow modes.

Figure 25:
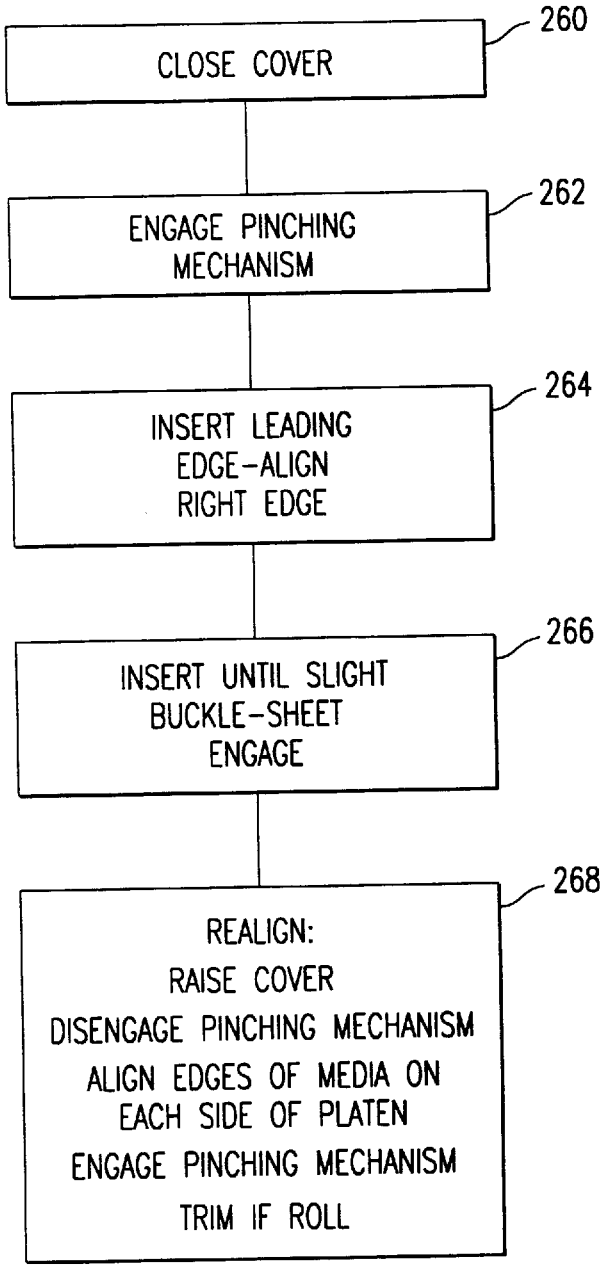
FIG. 25 is a flow chart illustrating the feeding of sheet and roll media to the printer/plotter.

Referring now to FIG. 25, the media loading procedure is illustrated by a flow diagram. The first box 260 discloses the step of closing the printer/plotter cover. The second box 262 discloses the step of engaging the pinching mechanism. The third box 264 discloses the step of inserting the leading edge of the media while aligning the right edge. The fourth box 266 mentions the insertion step, until the media buckles and the media is engaged by the drive platen. The last box 268 outlines the important realignment process which includes raising the cover, disengaging the pinching mechanism, aligning the edges of the media exiting the plotter with the media entering the plotter, engaging the pinching mechanism and then trimming the media if from a roll.

Figure 26:
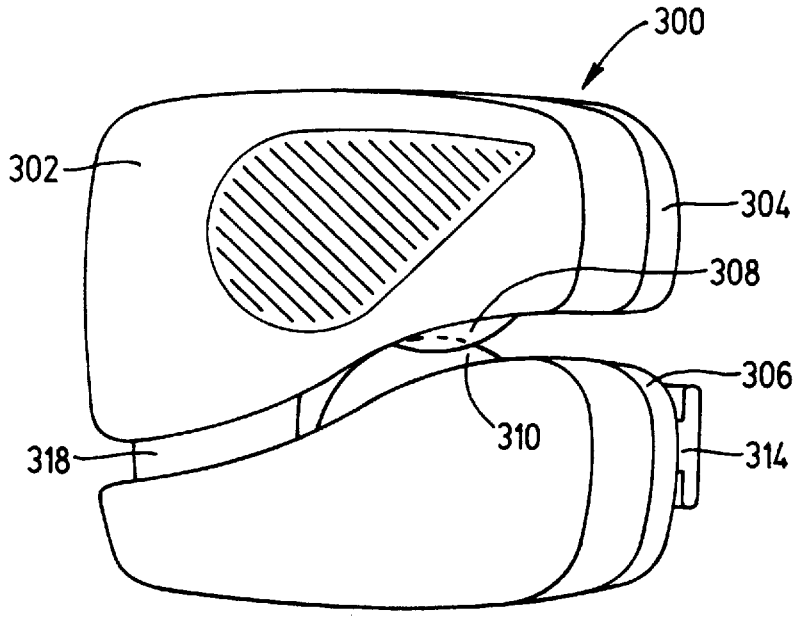
FIG. 26 is a front pictorial view of a cutting apparatus of the roll-feed apparatus.
Figure 27:
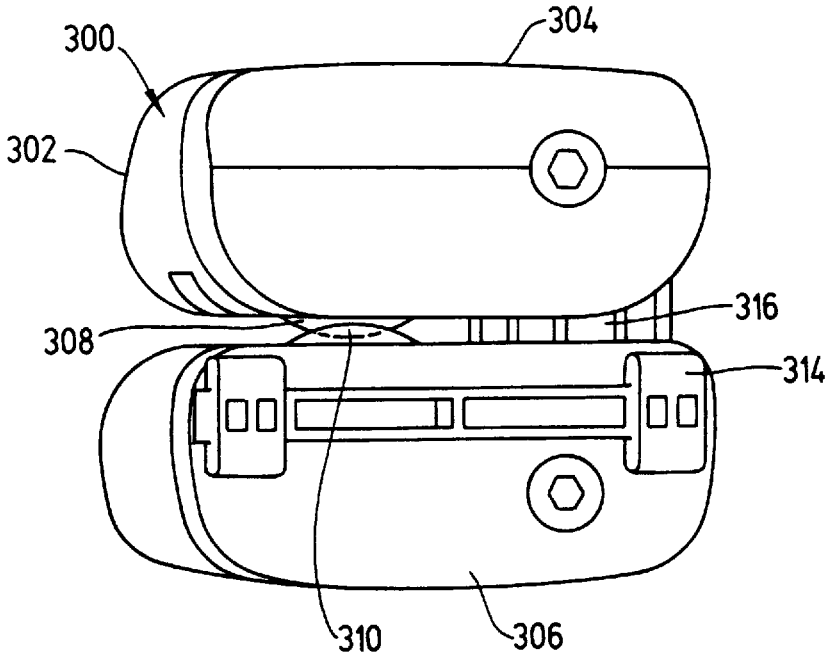
FIG. 27 is a rear pictorial view of the cutting apparatus.
Figure 28:
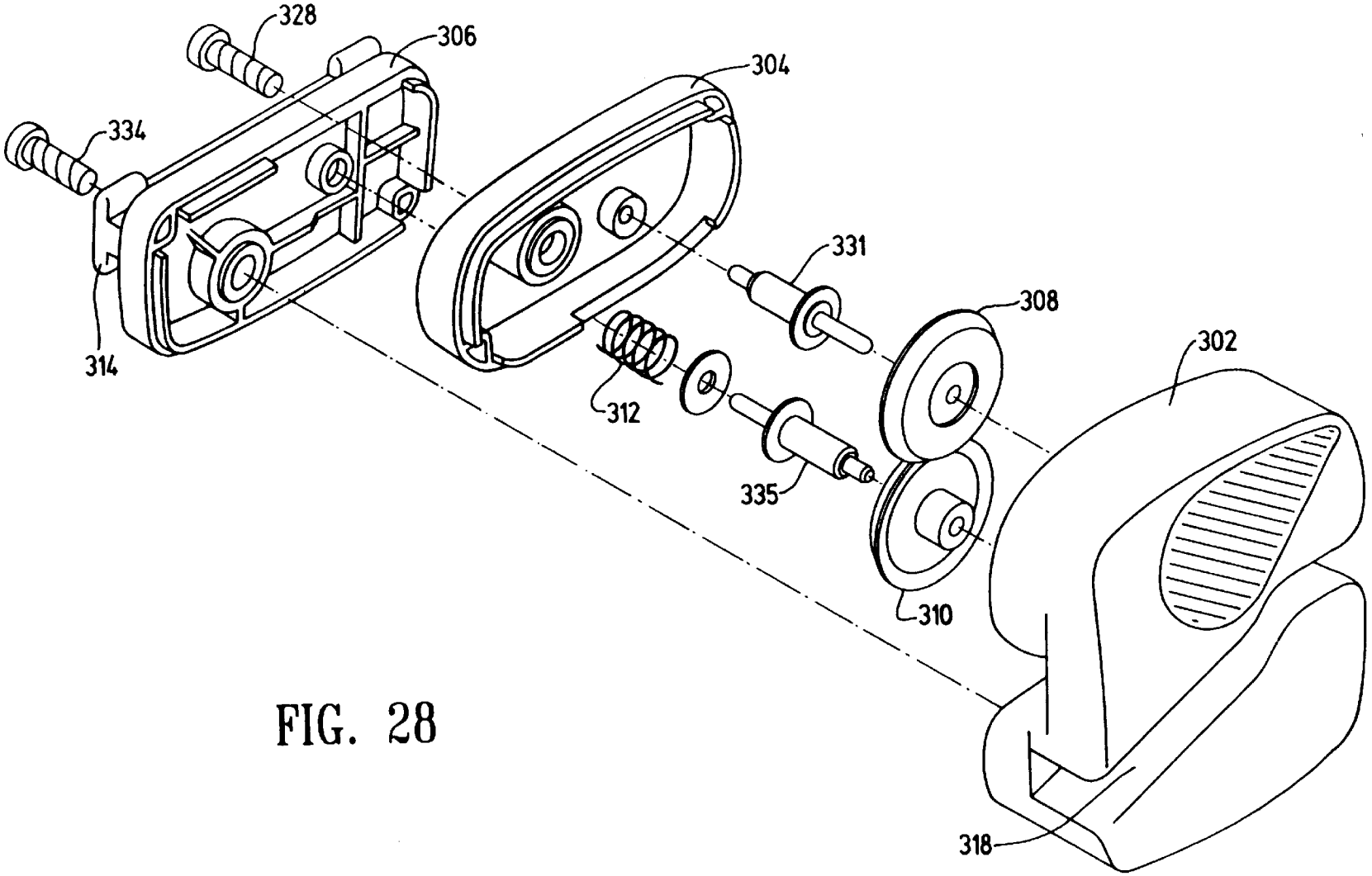
FIG. 28 is an exploded pictorial view of the cutting apparatus.
Figure 29:
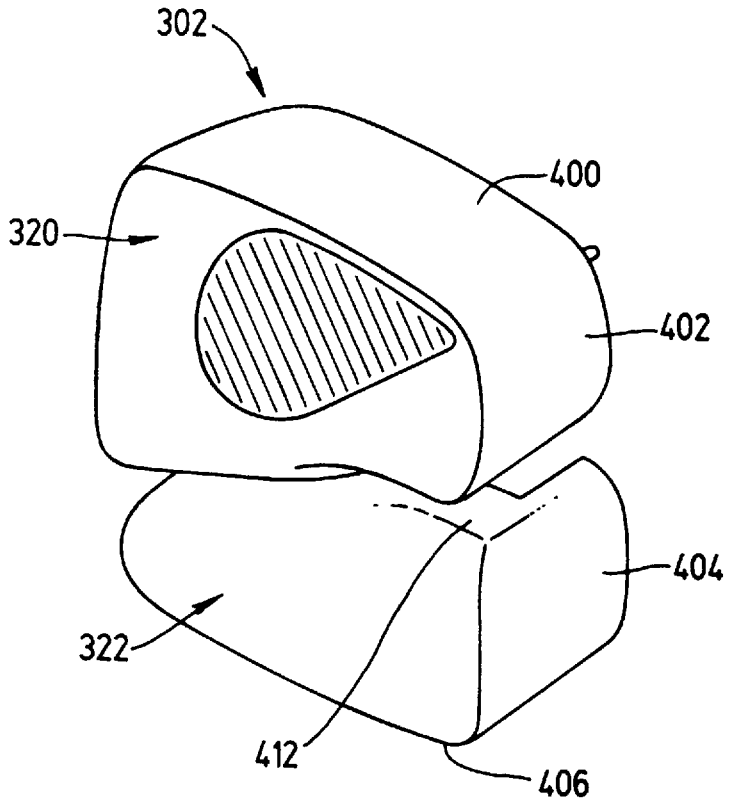
FIG. 29 is a front pictorial view of a housing base of the cutting apparatus.
Figure 30:
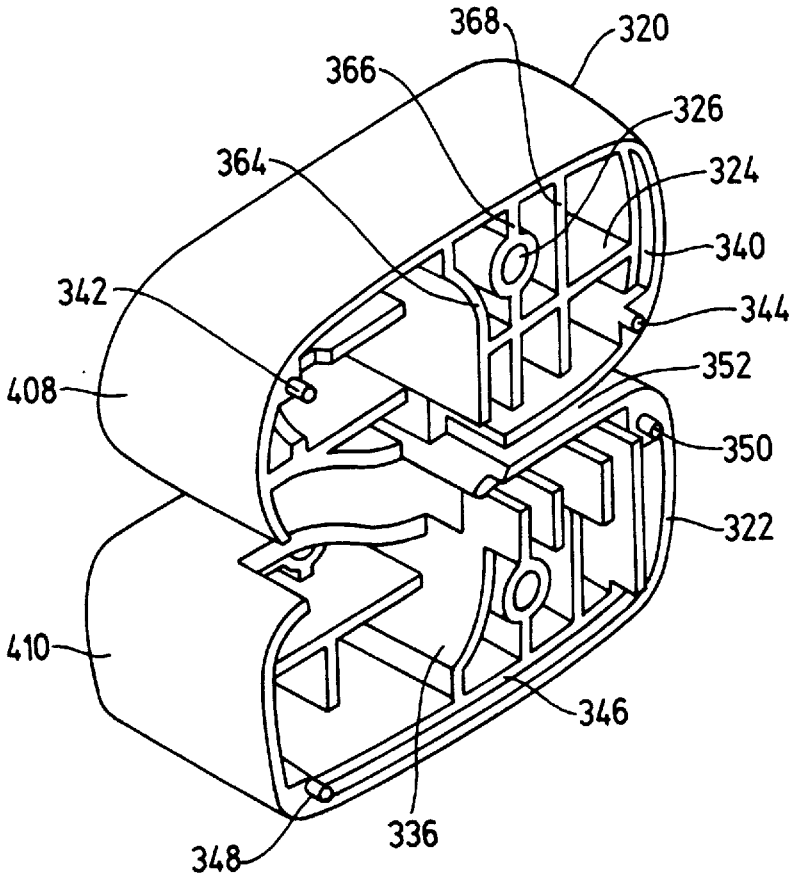
FIG. 30 is an interior pictorial view of the housing base.
Figure 32:
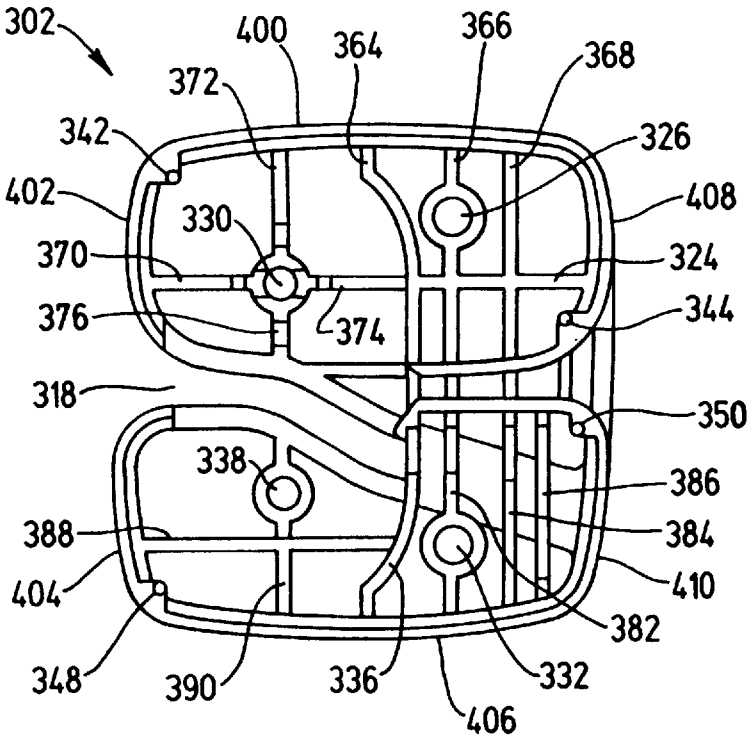
FIG. 32 is a rear elevational view of the housing base.
Figure 31:
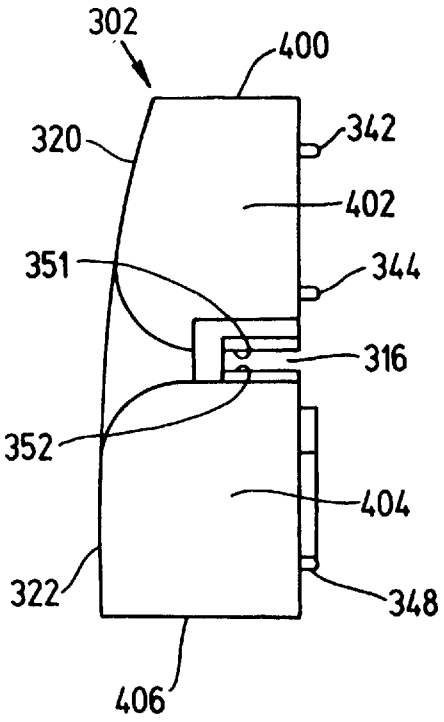
FIG. 31 is a left side elevational view of the housing base.
Figure 34:
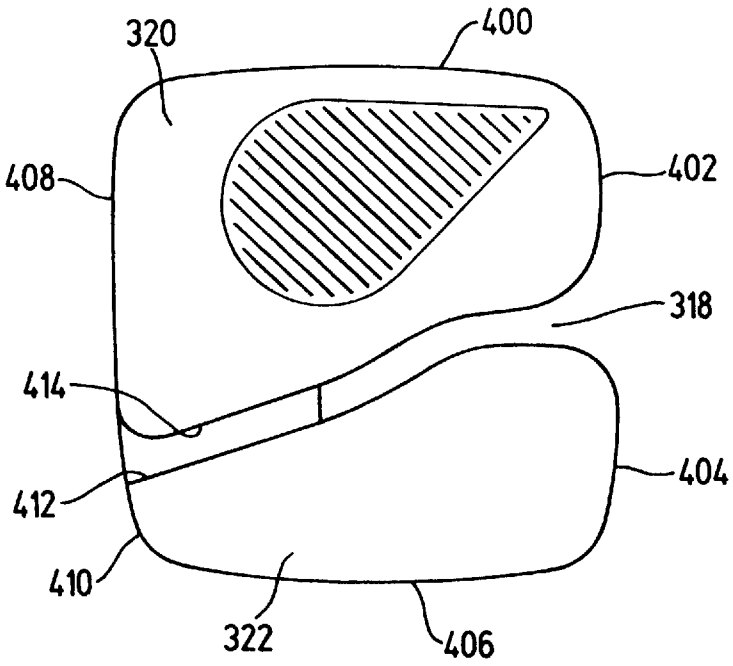
FIG. 34 is a front elevational view of the housing base.
Figure 33:
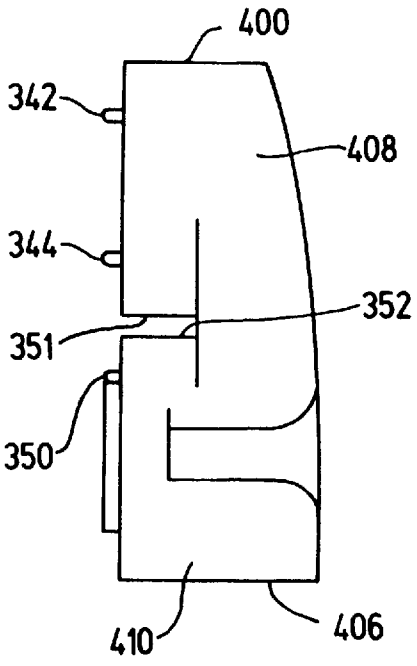
FIG. 33 is a right side elevational view of the housing base.

Referring now to FIGS. 26, 27 and 28, the cutting apparatus is shown in detail. The cutting apparatus is relatively simple, reliable and inexpensive as will be apparent from its description. It includes a housing 300 which comprises a one piece base 302, an upper cover 304 and a lower cover 306. Mounted within the housing are two slitter blades 308 and 310. A spring 312 is mounted within the housing and biases the blades together. The spring pushes on an adjacent axial bushing 337. The bushing is washer-like and includes a small cylindrical protrusion which pushes against the blade through a very small ring area contact thereby minimizing the amount of friction torque.

The cutting apparatus is attached to the guide rail 46 by a guide flange 314 which is integrally molded with the lower cover. When mounted, a user grips the upper portion of the housing and slides the cutting apparatus along the guide rail so that the sheet media to be cut is engaged by the two blades.

A major feature of the cutting apparatus is that after being cut, the two segments of sheet media proceed along different non-parallel paths. In particular, the cutting apparatus is designed to move from left to right across the sheet media which has exited the inkjet printer/plotter. Thus, the media enters the opening immediately in front of the slitter blades, is then engaged by the slitter blades, and the segment of the sheet media still attached to the printer/plotter proceeds along a first passage 316 located between the two covers 304 and 306. This passage is generally linear. The segment of the sheet media which is "cut loose" from the printer/plotter travels along a passage 318 molded into the base 302. This path is generally curved, causing the loose segment to move downwardly and away from the attached media.

Referring now to FIGS. 29–34, the housing base 302 is shown and will be described in detail. The base is a one piece molded, plastic part and is generally divided into two sections, an upper section 320 and a lower section 322. The upper section includes a reinforcing rib 324, an opening 326 to receive a fastener, such as a screw 328, and a bearing 330 to receive a shaft 331 supporting the upper blade. Another opening, 332, is provided in the lower section to receive another fastener, such as a screw 334. The lower section also includes reinforcing ribs, such as a rib 336, and a bearing 338 to receive a shaft 335 supporting the lower blade.

Around the periphery of the upper section is a recess 340 and two alignment guide pins 342 and 344. Similarly, in the lower section of the base there is a peripheral recess 346 and alignment guide pins 348 and 350.

The linear passage 316 is discernible and is partially defined by a lower wall 351 of the upper section and an upper wall 352 of the lower section of the base. The curved passage is formed between the outer walls 320, 322 of the base.

The interior of the upper section also includes three generally upstanding ribs 364, 366 and 368, and smaller ribs 370, 372, 374 and 376 surround the bearing 330. The interior of the bottom section includes three upstanding ribs 382, 384 and 386 and two smaller ribs 388 and 390.

The base includes a top wall 400, a front upper wall 402, a front lower wall 404, a bottom wall 406 and two back walls 408 and 410. The lower section also has an interior upper wall 412 which forms with an interior lower wall 414 of the upper section the curved passageway 318.

Figure 36:
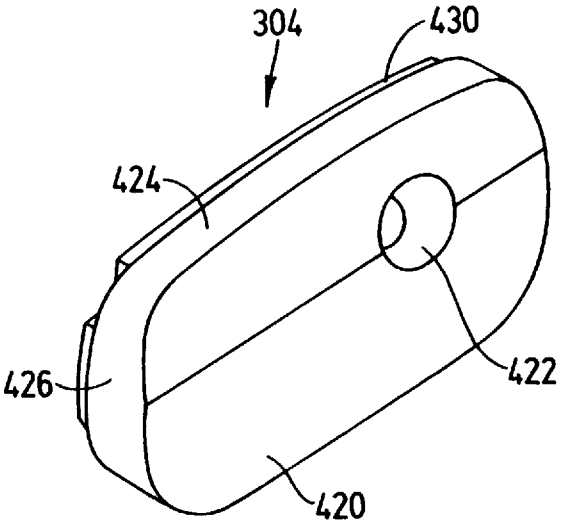
FIG. 36 is a front pictorial view of the upper cover.
Figure 35:
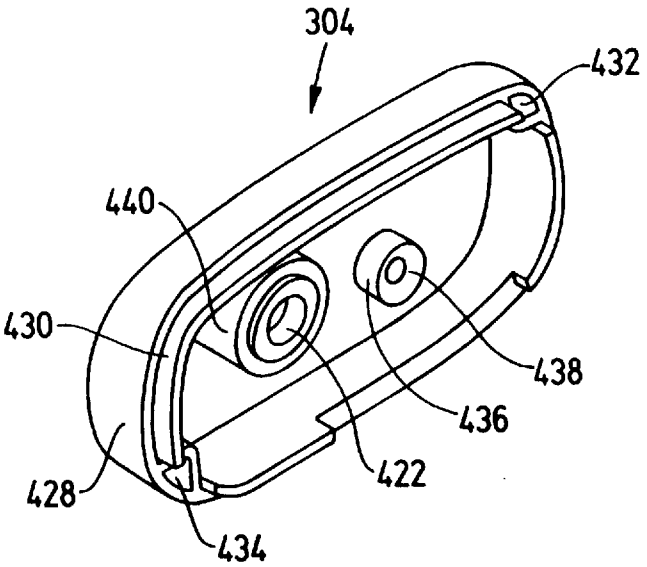
FIG. 35 is an interior pictorial view of an upper cover of the housing.
Figure 37:
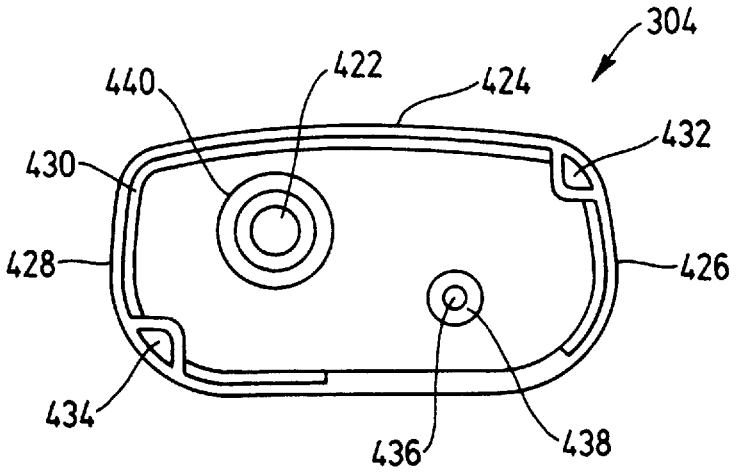
FIG. 37 is a rear elevational view of the upper cover.

Referring now to FIGS. 35, 36 and 37, the upper cover 304 is shown in more detail. The cover includes an outer wall 420 with an opening 422 for the screw 328. There is also a top outer wall 424, a front wall 426 and a back wall 428. Internally, there is a flange 430 which extends about the cover. This flange is received by the recess 340 of the upper section of the base when the cover is attached. In addition, there are two triangularly shaped openings 432, 434 for receiving the guide pins 342 and 344, respectively. In the interior of the cover is a bearing 436 having a funnel shaped surface 438 to guide the blade shaft 331 during assembly. There is also an upstanding cylindrical post 440 for receiving the screw 328.

Figure 39:
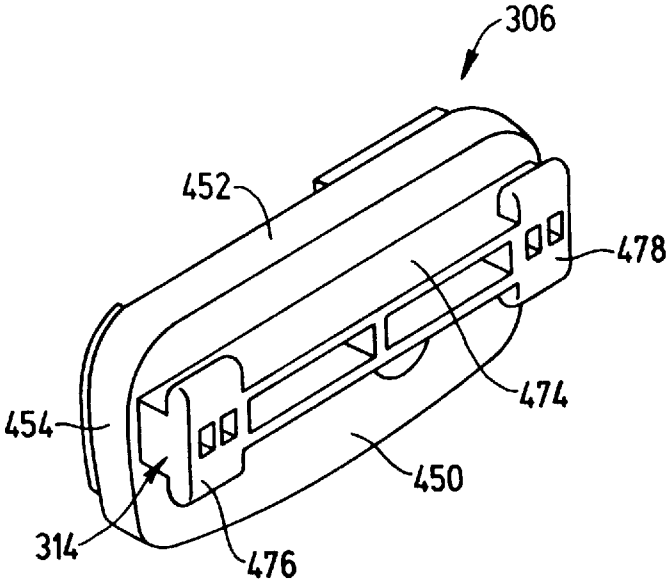
FIG. 39 is a front pictorial view of the lower cover.
Figure 38:
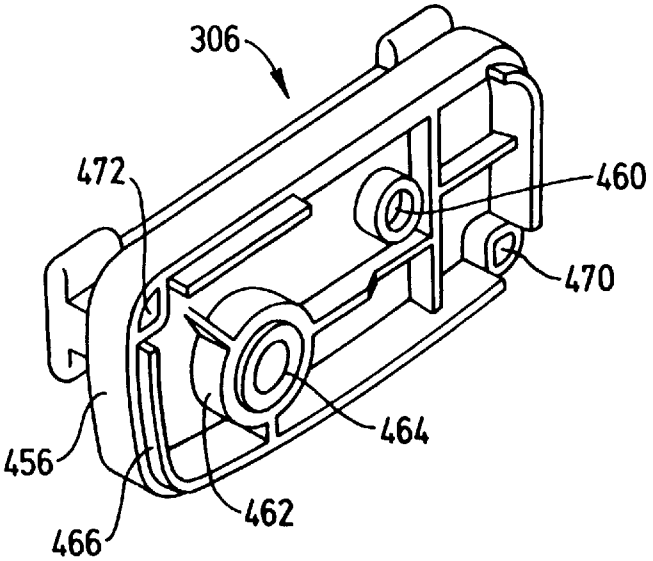
FIG. 38 is a rear pictorial view of a lower cover of the housing.
Figure 40:
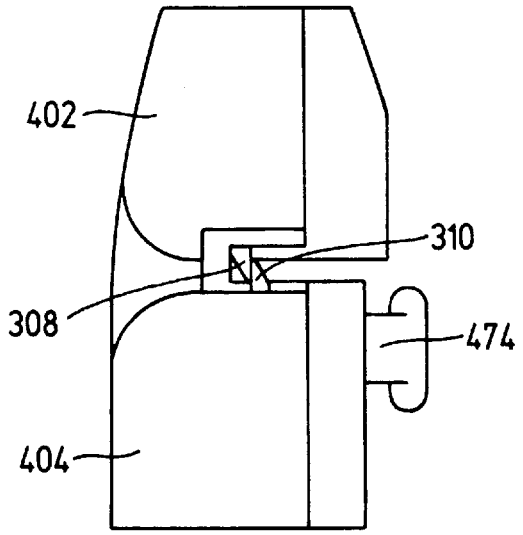
FIG. 40 is a left side elevational view of the cutting apparatus.

Referring now to FIGS. 38 and 39, the cover for the lower section of the base is detailed. Once again, there is an outer surface 450, a top surface 452, a front surface 454 and a rear surface 456. The interior of the lower cover includes a circular flange 460 around which is positioned one end of the coil spring 312 and for forming a bearing for the shaft 335, and the interior includes a cylindrical screw support 462 with a circular flange 464. Also surrounding the periphery of the lower cover is a flange 466 which is received by the recess 346 in the lower section of the base when the cover is attached. Also present are two openings 470 and 472 for receiving the guide pins 348 and 350, respectively. Integral with the outer wall 450 is the guide rail flange 314 having end flanges 476 and 478. The many ribs in the housing provide that the base and covers are very stiff. This in turn prevents the blades from separating from one another during a cutting operation.

Referring now to FIGS. 40–46, the cutting blades are shown in detail. Each blade is in the form of a disk, such as disk 480, having a front surface 482 and a rear surface 484. Along the periphery of the disk is a beveled edge 486. This beveled edge is formed at a 45° angle from the plane of the front surface. The back surface includes a circular wedge or ramp 488 which extends at approximately 10° from the plane formed by the rear surface. The edge of the blade, between the beveled surface 486 and the rear surface 484 is a cylindrical surface 485, having a length of about 0.5 mm.

Each blade is mounted to a shaft, such as the shafts 331, 335, each having a central large diameter portion 492 and two journal portions 494, 496. The journal portions are received by the bearings formed in the base and covers of the housing. It is intended that rolling friction is very low by this design. The shaft 335 includes a front flange 498 and a bearing surface 500. Mounted on the shaft 335 is a spring guide 502 having a circular recess 503 which is to constrain the end of the spring 312 opposite that end constrained by the flange 460 of the cover 306. On the face of spring guide 502 opposite that having the recess there is a small cylindrical shape bushing 337 which makes a small ring shaped contact with the front flange 498 of the shaft 335 to which is mounted the slitter blade 310.

Figure 41:
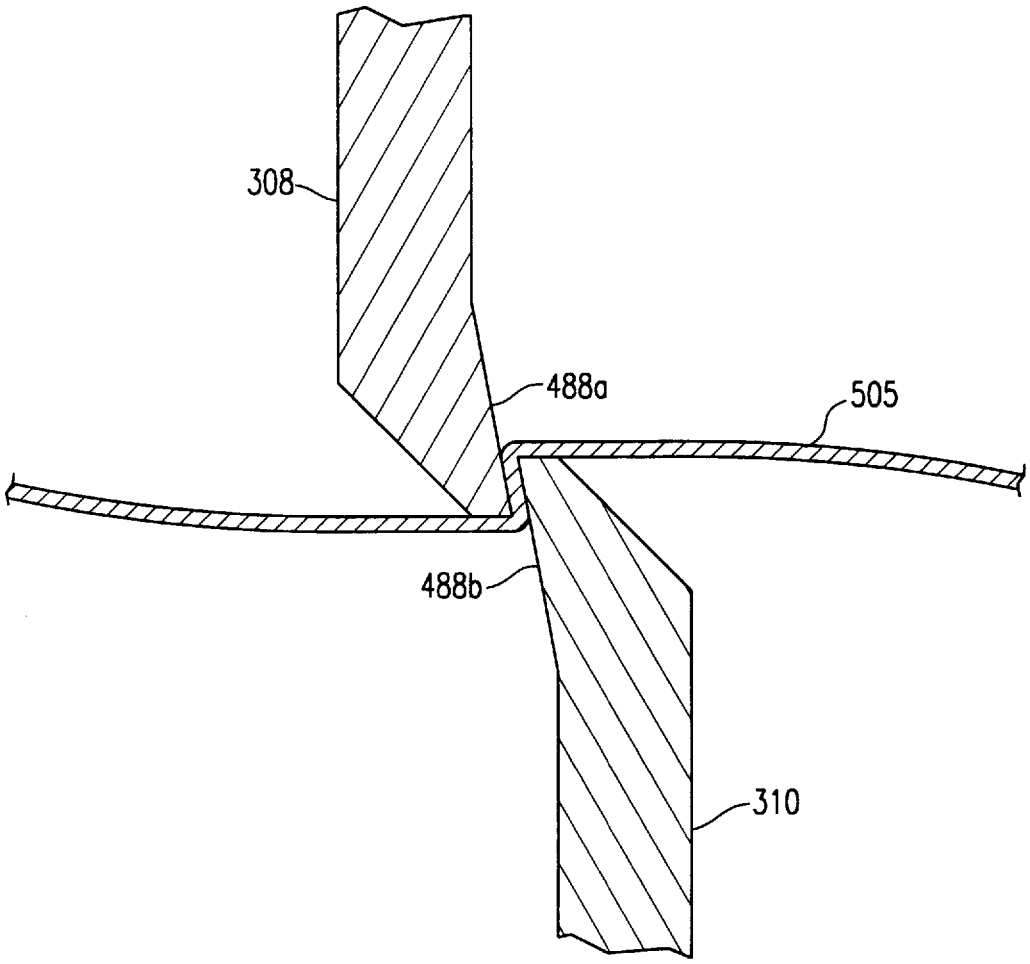
FIG. 41 is an enlarged sectional view of portions of slitter blades of the cutting apparatus.
Figure 42:
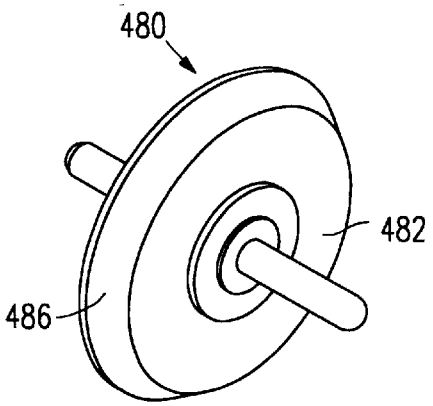
FIG. 42 is a front pictorial view of a slitter blade of the cutting apparatus.
Figure 43:
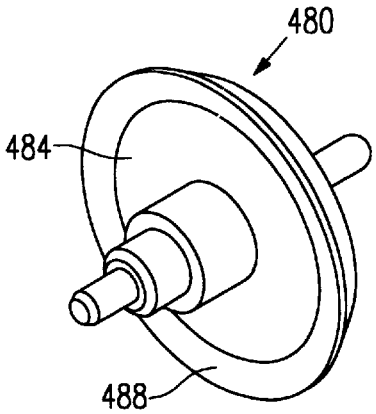
FIG. 43 is a rear pictorial view of the slitter blade.
Figure 44:
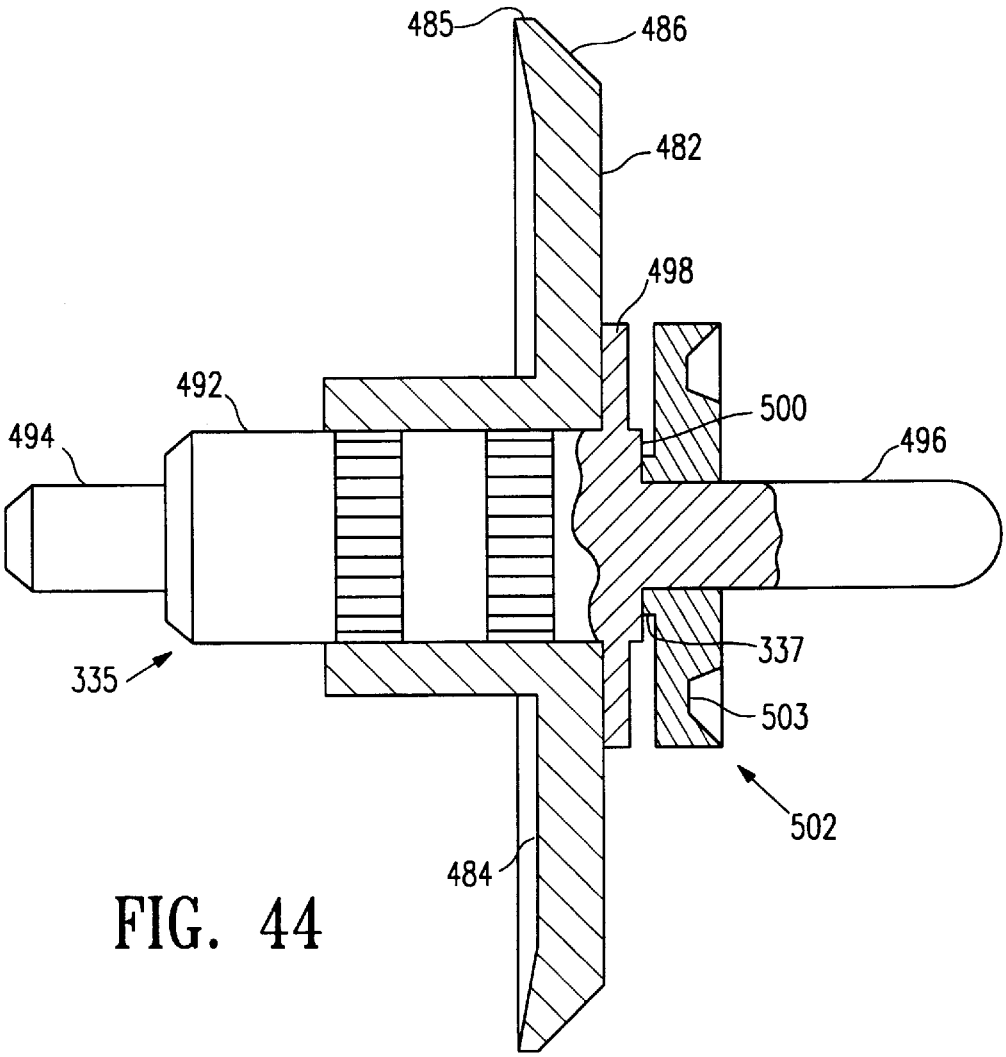
FIG. 44 is an enlarged cross sectional view of the slitter blade, and an elevational view of a shaft upon which the blade is mounted.
Figure 45:
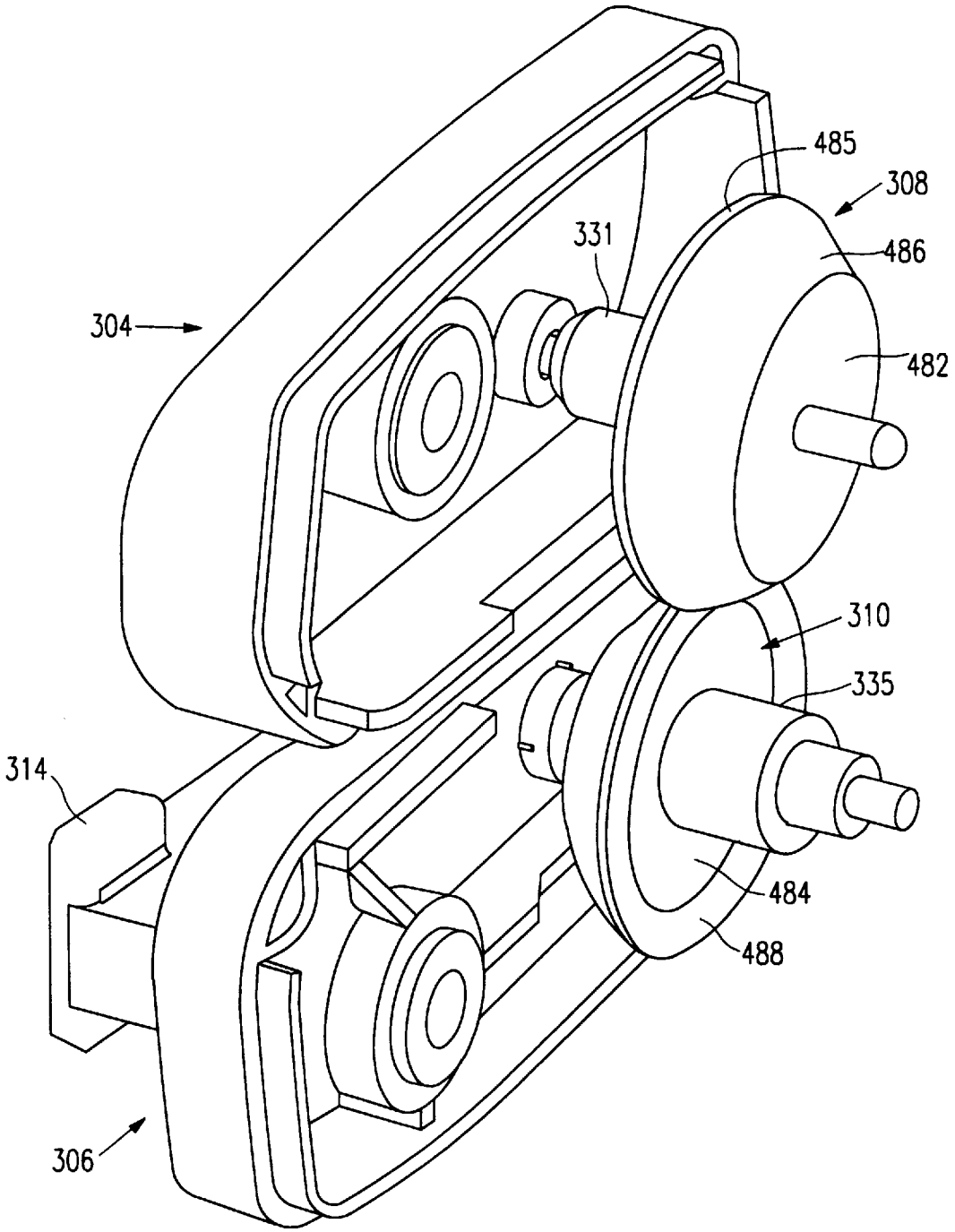
FIG. 45 is an enlarged pictorial view of the interior of the cutting apparatus.
Figure 46:
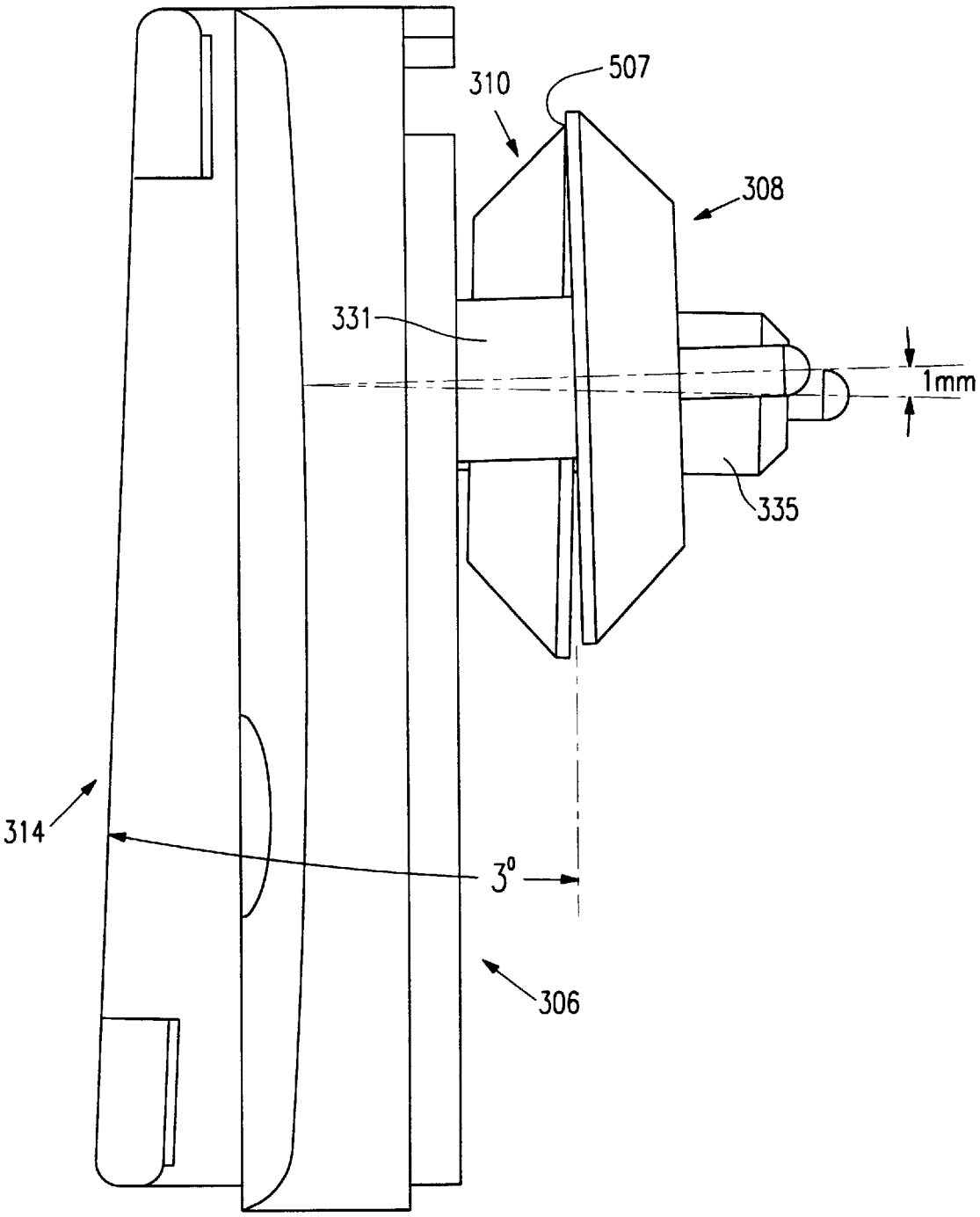
FIG. 46 is a top plan view of the interior of the cutting apparatus.

The upper blade 308 and the lower blade 310 are disposed in opposite directions so that they engage each other as shown in FIGS. 41, 45 and 46 where the ramp 488*a* of the blade 308 and the ramp 488*b* of the blade 310 are in engagement. It can be seen that they abut each other at an angle because of the 10° ramps and because the blades are offset as shown in FIG. 46. The offset offers the advantage of "point" contact of the blades. The overlap designated 507 of the two blades is very small, about 0.55+ or −0.15 mm. This non-parallel disposition of the rotation axes of the blades is achieved by an offset in the bushings of about 1 mm. The angular difference between a line intermediate of both blades and a corresponding line along the backside of guide flange 314 is about three degrees. It should also be noted that the contact is at the front of the apparatus where the media makes first contact with the blades. All of this is to ensure a quality cut even when a difficult media like polyester is used by the printer/plotter. Because at least one of the blades is spring biased, the abutment of the two ramps

488*a* and 488*b* is maintained with a predetermined force of about 1.25N plus or minus 10%. The biasing of the blades together also compensates for wear that will occur. A material to be cut, such as paper 505, is entrapped between the two blades and a shearing cut is made.

In the preferred embodiment, the housing base and upper cover are made of injection molded PC+FG+PTFE; the lower cover is made of POM+PTFE; the blades are made of stainless steel AISI 420 F hardened to 51 HRC, and the shafts are made of stainless steel AISI 303.

Figure 47:
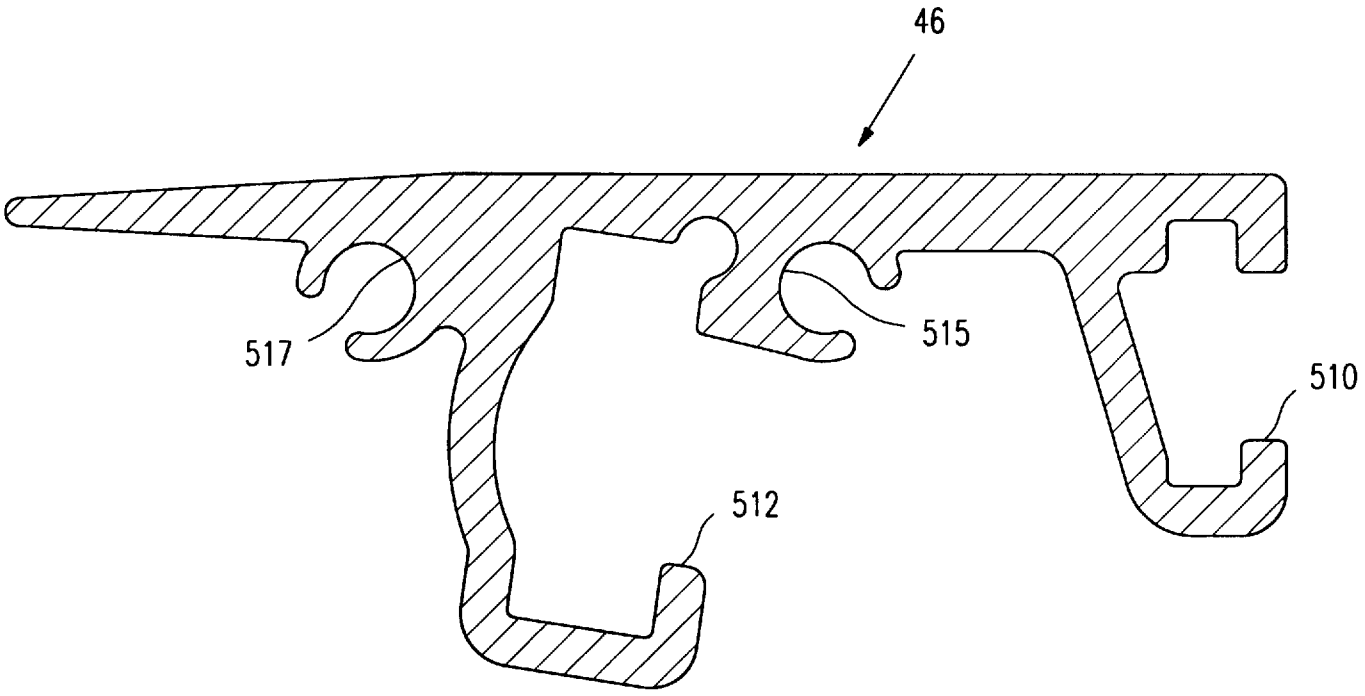
FIG. 47 is a sectional elevational view of a guide rail.
Figure 48:
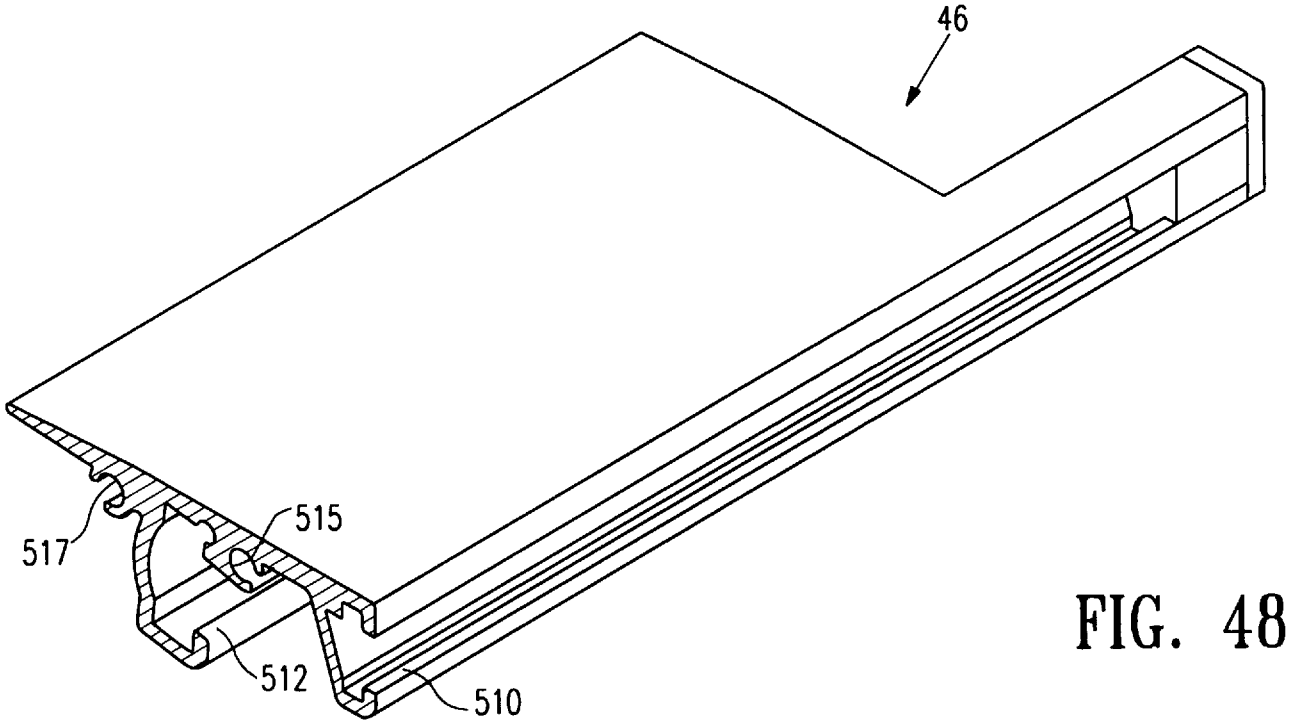
FIG. 48 is a pictorial view of the guiderail.
Figure 49:
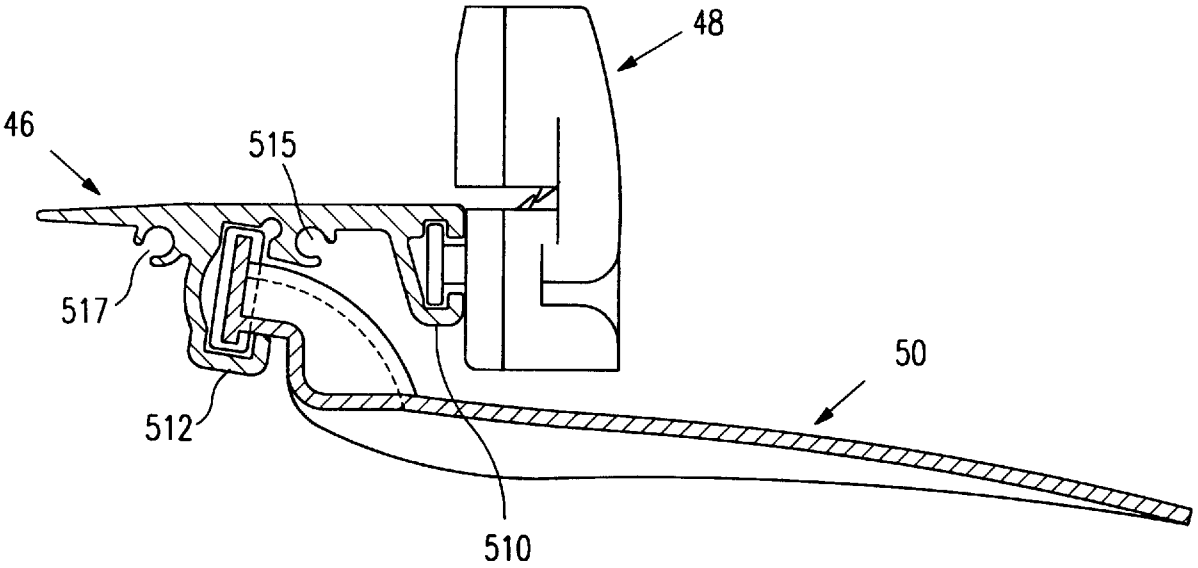
FIG. 49 is a pictorial view of the guide rail with the cutting apparatus and a deflector mounted thereto.

Referring now to FIGS. 47, 48 and 49, the guide rail 46 is described in more detail. The guide is extruded aluminum having a track 510 for the cutting apparatus 48, and a second track 512 for the deflectors 50, 52, 54. Two curved channels 515 and 517 are provided to receive screws that connect the guide rail to the brackets 60 and 164. The track cutting apparatus is offset by about 30 relative to the track with the cutting function.

Figure 50:
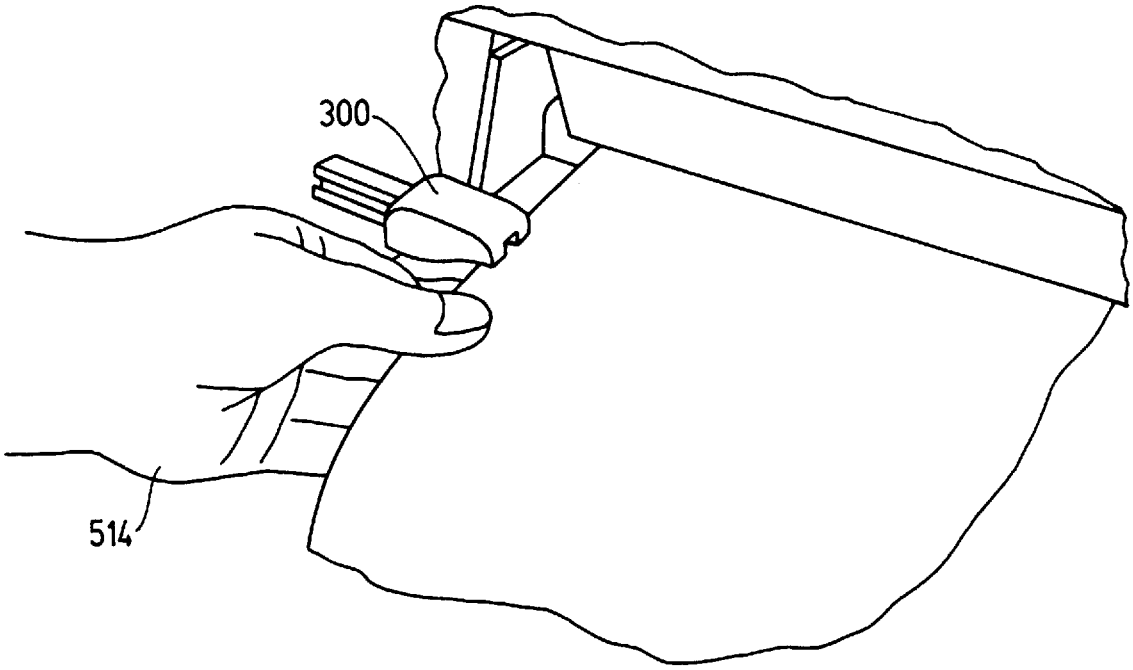
FIG. 50 is an illustration of an operator gripping media to be cut.
Figure 51:
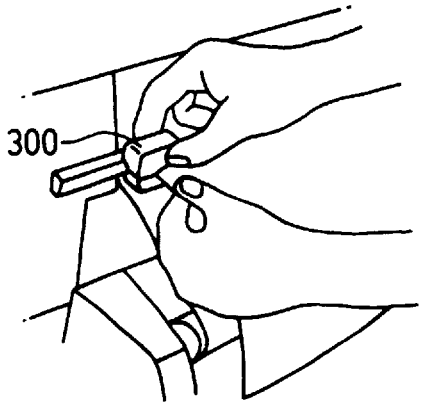
FIG. 51 is an illustration of the operator gripping the cutting apparatus.
Figure 52:
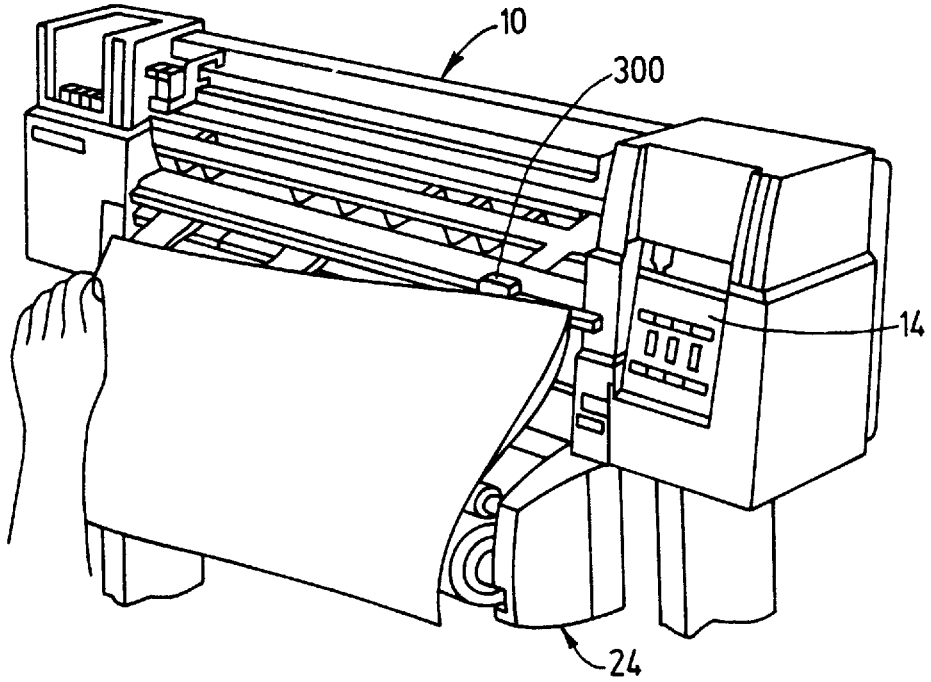
FIG. 52 is an illustration of media being cut by the cutting apparatus.

In operation, as shown in FIGS. 50–52, the cutter apparatus rides along the guide rail 46 and is normally parked at the left edge of the rail. When a user desires to cut the sheet media which has been printed by the inkjet printer/plotter, the operator grips the media with his/her left hand 514 as close as possible to the cutting apparatus and holds the media taut. The operator then grips the cutting apparatus with his or her thumb and index finger of the right hand and guides the cutter across the media sheet. A linear cut is made in which the new edge closest to the printer/plotter is guided through the linear passage of the cutter, whereas the sheet segment that is being separated from the printer/plotter is guided downwardly away from its original position by following the curved passage in the cutting apparatus.

We claim:

1. A removable roll-feed apparatus for use with a printer/plotter comprising:

a support;

a horizontally disposed shaft mounted to said support, said shaft for mounting a roll of media;

two oppositely disposed and horizontally positioned pins connected to said support, one of said pins being movable between disconnected mode and a connected mode, said pins for contacting said printer/plotter and for positioning said support relative to said printer/plotter in a direction parallel to a first axis, wherein said first axis is the coordinate generally vertically disposed and parallel to the front of the printer/plotter;

a first surface on said support for positioning said support relative to said printer/plotter in a direction parallel to a second axis, wherein said second axis is the coordinate generally perpendicular to the front of the printer/plotter;

a second surface on said support for positioning said support relative to said printer/plotter in a direction parallel to a third axis, wherein said third axis is the coordinate generally horizontally disposed and parallel to the front of the printer/plotter;

said first, second and third axes being mutually perpendicular;

said support having two modes in relation to said printer/plotter, a connected mode and a disconnected mode;

said support being in a connected mode when said pins are in contact with said printer/plotter, said first surface abuts said printer/plotter and said second surface abuts said printer/plotter;

said support being in a disconnected mode when said support is spaced from said printer/plotter and is not in a working relationship with said printer/plotter; and said support being located relative to said printer/plotter when in a connected mode to allow single sheet media feeding of said printer/plotter when said roll of media is mounted to said shaft and is not being fed to said printer/plotter.

2. A roll-feed apparatus as claimed in claim 1, including:

a cutting apparatus; and means connected to said supporting means for mounting and guiding said cutting apparatus.

3. A roll-feed apparatus as claimed in claim 1, including:

mounted to said support means for diverting media from said roll of media.

4. A removable roll-feed apparatus as claimed in claim 1 including:

spring biased connectors connected to said support; and projections connected to said printer/plotter for engaging said spring biased connectors when said roll feed apparatus is attached to said printer/plotter.

5. A removable roll-feed apparatus as claimed in claim 4 wherein:

said support includes a horizontal member and two vertical portions; and including:

a diverter roller connected to said vertical portions disposed generally parallel to said shaft.

6. A removable roll-feed apparatus as claimed in claim 5 wherein:

each of said vertically disposed portions of said support includes a first opening for forming a first bearing;

a second opening spaced from said first opening for forming a second bearing;

said second opening being formed between a lower fixed arm having an elongated top surface and a first recess forming part of the second bearing, and an upper pivotal arm having a bottom cam follower surface and a second recess forming another part of the second bearing;

a spring connected to said fixed arm and to said pivotal arm for biasing said arms toward each other;

said diverter roller is received by the second openings of said vertically disposed portions; and said shaft for mounting a roll of media is adapted to be received by the second openings of said vertically disposed portions, wherein said shaft acts as a cam against the bottom surface of said upper pivotal arm.

7. A removable roll-feed apparatus as claimed in claim 6 including:

a cutting apparatus having a housing that includes a base divided into an upper section and a lower section, said upper section having reinforcing ribs, a cylindrical bearing opening and a cylindrical fastener receiving opening;

said lower section having reinforcing ribs, a cylindrical bearing opening and a cylindrical fastener receiving opening;

an upper cover including a fastener receiving opening and a cylindrical bearing opening having a funnel shaped entry portion; and a lower cover including a fastener receiving opening and a cylindrical bearing opening;

a first shaft mounted to and received by said bearing openings of said upper section and said upper cover;

a second shaft mounted to and received by said bearing openings of said lower section and said lower cover;

each of said shafts having an axis and being mounted so that the axes of said shafts are non-parallel;

a first slitter blade mounted in said housing to said first shaft;

a second slitter blade mounted in said housing to said second shaft, said second blade being in contact with said first blade; and a coil spring mounted in said housing between said lower cover and said second blade to bias said second blade into contact with said first blade.

8. A removable roll-feed apparatus adapted to be attached to a printer/plotter comprising:

a shaft for mounting a roll of media;

two side frame members for supporting said shaft;

a strengthening element connecting said frame member;

a diverter roller mounted to said frame members in a position generally parallel to said shaft;

oppositely disposed pins connected to said frame members for engaging said printer/plotter;

surfaces on said printer/plotter for receiving said pins;

a guide rail connected to said frame members; and a cutting apparatus mounted to said guide rail and disposed to move along said rail to cut media coming from said printer/plotter.

9. A roll-feed apparatus as claimed in claim 8, including:

oppositely disposed spring clips connected to said frame members for releasably connecting said frame members to a printer/plotter.

10. A roll-feed apparatus as claimed in claim 8, including:

two surfaces connected to said frame members for locating said frame members relative to said printer/plotter.

11. A roll-feed apparatus as claimed in claim 10, including:

means connected to said frame members for inducing friction on said mounting shaft.

12. A method for mounting a roll feed apparatus on a printer/plotter comprising the steps of:

providing a shaft for mounting a roll of media, said shaft being supported by first and second side frame members, said frame members having height, width and depth coordinates;

providing first and second pins, said first pin connected to said first frame member and said second pin connected to said second frame member;

connecting said second pin to said second frame member so as to be movable between extended and retracted positions;

providing a connector for attaching said frame members to said printer/plotter;

connecting said first pin to said printer/plotter;

pivoting said shaft and frame members to cause alignment with said printer/plotter;

connecting said second pin to said printer/plotter;

rotating said shaft and said frame members toward said printer/plotter using said first and second pins as an axis; and engaging said printer/plotter with said connector to constrain movement of said shaft and frame members in a direction parallel to the height coordinate of said frame members.

13. A method as claimed in claim 12, including the steps of:

providing a diverter roller mounted to said frame members;

providing a roll of media mounted to said shaft;

moving media from said roll around said diverter roller;

aligning said media with said printer/plotter;

inserting said media into said printer/plotter; and realigning said media by aligning media exiting said printer/plotter with media entering said printer/plotter.

14. A method as claimed in claim 13, including the steps of:

providing a cutting apparatus mounted to a guide rail, said guide rail being supported by said two side frame members;

gripping media exiting from said printer/plotter with one hand of an operator; and sliding the cutting apparatus along the guide rail with the other hand of said operator.

15. A method as claimed in claim 12 including the steps of:

providing a first surface on said frame members for limiting movement of said frame members relative to said printer/plotter in a direction parallel to the depth coordinate of said frame members; and providing a first surface on said printer/plotter for engaging said first surface of said frame members.

16. A method as claimed in claim 15 including the steps of:

providing a second surface on said frame members for limiting movement of said frame members relative to said printer/plotter in a direction parallel to the width coordinate of said frame members; and providing a second surface on said printer/plotter for engaging said second surface of said frame members.

* * * * *